US005960239A

United States Patent [19]

Toyoshima et al.

[11] Patent Number: 5,960,239

[45] Date of Patent: Sep. 28, 1999

[54] DEVELOPING DEVICE WITH DEVELOPER CHARGING AND APPLICATION REGULATING MEMBER

[75] Inventors: Tetsuro Toyoshima, Soraku-gun; Nobuyuki Azuma, Ibaraki; Takayuki Yamanaka, Tenri, all of Japan

[73] Assignee: Sharp Kabushiki Kaisha, Osaka, Japan

[21] Appl. No.: 08/959,615

[22] Filed: Oct. 28, 1997

[30] Foreign Application Priority Data

Oct. 31, 1996 [JP] Japan ..... 8-290530

[51] Int. Cl.[6] ..... G03G 15/06

[52] U.S. Cl. ..... 399/284

[58] Field of Search ..... 399/265, 279, 399/281, 284

[56] References Cited

U.S. PATENT DOCUMENTS

| | | | |
|---|---|---|---|
| 3,371,146 | 2/1968 | Compton | 174/17 R |
| 4,458,627 | 7/1984 | Hosono et al. | 399/274 |
| 4,566,402 | 1/1986 | Shimazaki | 399/284 |
| 4,748,472 | 5/1988 | Mukai et al. | 399/284 X |
| 4,920,916 | 5/1990 | Mizuno et al. | 399/284 |
| 4,990,959 | 2/1991 | Yamamuro et al. | 399/284 X |
| 5,170,213 | 12/1992 | Yamaguchi et al. | 399/281 |
| 5,373,353 | 12/1994 | Fukasawa | 399/284 |
| 5,587,776 | 12/1996 | Watabe et al. | 399/284 |
| 5,729,806 | 3/1998 | Niwano et al. | 399/284 |

FOREIGN PATENT DOCUMENTS

| | | |
|---|---|---|
| 60-22352 | 6/1985 | Japan . |
| 62-17774 | 1/1987 | Japan . |
| 63-15580 | 4/1988 | Japan . |
| 3-16025 | 3/1991 | Japan . |
| 4-73152 | 11/1992 | Japan . |
| 5-16210 | 3/1994 | Japan . |
| 5-52449 | 7/1994 | Japan . |

*Primary Examiner*—Fred L. Braun
*Attorney, Agent, or Firm*—Nixon & Vanderhye P.C.

[57] ABSTRACT

A developing device has a development roller for carrying toner on a surface thereof, a toner supply roller for supplying the toner to the development roller, a flat spring which comes into contact with the development roller, charges the toner to be supplied to the development roller and applies the toner to the development roller while regulating the thickness of a layer of the toner. The flat spring has a plurality of flat-plate parts including a contact flat-plate part which comes into contact with the development roller, and a curved part which connects the flat-plate parts to each other. In this structure, by arbitrarily selecting dimensional parameters of the flat spring, it is possible to easily obtain various flat springs having different properties. Therefore, for example, the stress to the toner and the stress to the members can be easily reduced simultaneously with a design of the flat spring. Moreover, it is possible to improve the uniformity of the toner layer thickness in the axis direction of the development roller and the uniformity of charging of the toner.

28 Claims, 16 Drawing Sheets

$L_1$= 10mm $L_2 = 22\,mm$ $t_2 = 0.2\,mm$ $L_3$= 22 mm $t_3$= 0.2 mm

DEVELOPING DEVICE WITH DEVELOPER CHARGING AND APPLICATION REGULATING MEMBER

FIELD OF THE INVENTION

The present invention relates to developing devices for developing an electrostatic latent images using a one-component developer (hereinafter referred to as the toner), such as a developing device for use in an image forming apparatus, for example, a compact copying machine, optical printer, and facsimile machine employing an electrophotographic method. The present invention more particularly relates to developing devices provided with a developer charging and application regulating member which charges the toner to be supplied to a developer carrier and applies the toner to the developer carrier while regulating the thickness of a layer of the toner.

BACKGROUND OF THE INVENTION

A so-called electrophotographic optical printer is known as a printing device. The optical printer is a device for developing an electrostatic latent image formed on a photoreceptor into a visible image with toner which has been charged beforehand by a developing device and for transferring the visible image to a transfer member. The electrostatic latent image is formed on the photoreceptor by exposing or scanning the photoreceptor using a laser beam modulated according to information input from a computer.

The developing methods used for a laser printer like the optical printer are roughly classified into two types, namely a two-component developing method and a one-component developing method. The two-component developing method uses a two-component developer containing carrier and non-magnetic toner or magnetic toner. The one-component developing method employs a one-component developer consisting of non-magnetic toner or magnetic toner.

In general, the two-component developing method requires a toner-concentration detecting sensor for controlling the mixing ratio of toner and carrier, and an agitator for mixing the toner and carrier. Consequently, the two-component developing method suffers from such disadvantages that the number of parts increases and the developing device becomes larger in size. Taking a reduction in the size of the developing device into consideration, a developing device employing the one-component developing method is very advantageous, and some one-component developing methods have been put to practical use in recent years.

In developing devices adopting a one-component developing method which have been recently put to practical use, a toner layer thickness regulating member is usually provided. The toner layer thickness regulating member regulates the thickness of a layer of toner on the developer carrier when charging the toner and applying the charged toner to the developer carrier. The regulating systems for regulating the thickness of the toner layer are classified into an elastic-body-using system and a rigid-body-using system according to the material of the toner layer thickness regulating member. The elastic-body-using system has a structure in which the toner layer thickness regulating member is formed by a blade having steel-like elasticity (energy elasticity) or rubber-like elasticity (entropy elasticity). On the other hand, the rigid-body-using system has a structure in which the toner layer thickness regulating member is formed by a rod or roller made of a resin with rigidity or a metal.

For example, Japanese Publications of Examined Patent Application No. 15580/1988 (Tokukosho 63-15580) and No. 73152/1992 (Tokukosho 4-73152) disclose an elastic trailing contact method that is one of the elastic-body-using systems. In this contact method, as shown in FIG. 13, an elastic member 52 is disposed so that its body part comes into contact with a development roller 51 as the developer carrier at a contact point Q' and that two wedge gaps are formed between the development roller 51 and the elastic member 52, one gap formed on an upstream side of the contact point Q' with respect to the rotating direction of the development roller 51 (the direction of the arrow D in FIG. 13) being larger than the other gap formed on a downstream side.

An end of the elastic member 52 located on the upstream side with respect to the rotating direction of the development roller 51 is fixed, while the other end located on the downstream side is a free end. The elastic member 52 includes a flat-plate-shaped flat spring with steel-like elasticity made of a metal, etc., and a soft elastic body (elastic body with rubber-like elasticity) made of rubber, plastics, etc.

In this structure, since a relatively thick toner layer is formed on the development roller 51, an image developed by the development roller 51 can have good image density. Moreover, since the elasticity of the flat-plate-like flat spring and of the soft elastic body of the elastic member 52 can be relatively easily selected, the degree of freedom in designing the elastic member 52 is high. It is thus possible to provide an optimum elastic member 52 for each developing device.

Additionally, an elastic counter contact method that is one of the elastic-body-using systems is disclosed in, for example, U.S. Pat. No. 4,458,627 (corresponding to Japanese Publication of Examined Patent Application No. 16736/1988). In this method, as shown in FIG. 14, an elastic regulating plate 53 is disposed so that its body comes into contact with the development roller 51 at the contact point Q' and that two wedge gaps are formed between the development roller 51 and the elastic regulating plate 53, one gap located on a downstream side of the contact point Q' with respect to the rotating direction of the development roller 51 (the direction of the arrow D in FIG. 14) being larger than the other gap formed on an upstream side.

An end of the elastic regulating plate 53 located on the upstream side with respect to the rotating direction of the development roller 51 is a free end, while an end thereof located on the downstream side is fixed. The elastic regulating plate 53 is made of a metallic plate with high elasticity, rubber plate, or the like.

In this structure, since a relatively large pressure is exerted at the contact point Q', it is possible to form a relatively thin toner layer on the development roller 51 as compared to the above-mentioned elastic trailing contact method, thereby providing a fine toner image.

On the other hand, for example, U.S. Pat. No. 3,731,146 (corresponding to Japanese Publication of Examined Patent Application No. 36070/1976) discloses a rigid bar contact method as one of the rigid-body-using system. In this contact method, as shown in FIG. 15, the toner layer thickness regulating member is formed by at least one rod-like rigid bar 54. In this method, residual toner or excessive toner remaining on the development roller 51 can be removed by pressing the rigid bar 54 against the development roller 51 using a spring (not shown).

Moreover, for example, Japanese Publication of Examined Patent Application No. 22352/1985 (Tokukosho 60-22352) discloses a rigid roller contact method that is also the rigid-body-using system. In this method, as shown in FIG. 16, a friction-type charging roller 55 made of a resin having rigidity and high frictional resistance is pressed against the development roller 51. In this method, the toner can be uniformly charged without lowering the charging efficiency. Additionally, since the toner is charged by charges accumulated on the friction-type charging roller 55 to have the same polarity as the charges, good development is performed without causing cohesion of toner particles.

In a developing device using one-component developer, particularly non-magnetic one-component developer, the toner cannot be transported and supplied to the developer carrier by magnetic force. Therefore, various methods have been proposed to supply and apply the toner to the developer carrier by pressing a toner supply member with elasticity against the developer carrier and rotating the toner supply member.

For example, in the method disclosed in Japanese Publication of Examined Patent Application No. 16025/1991 (Tokukohei 3-16025), an equalizing member for supplying toner to the developer carrier and collecting residual toner from the developer carrier is pressed against the developer carrier with a contact depth ranging from 0.3 to 2.0 mm, and the equalizing member and the developer carrier are rotated in the opposite directions so that they move in the same direction as the contact section thereof.

In this structure, since the equalizing member is pressed against the developer carrier with a contact depth in the above-mentioned range, the equalizing member and the developer carrier are rubbed uniformly. As a result, the toner is uniformly supplied to the developer carrier with stability.

Moreover, for example, Japanese Publication of Examined Patent Application No. 16210/1994 (Tokukohei 6-16210) discloses a structure in which an elastic foam roller with a porous surface which is rotated in the same direction as the developer carrier is provided as the toner supply member in contact with the developer carrier.

In this structure, since the developer carrier and the elastic foam roller are rotated in the same direction, the surface of the developer carrier and the surface of the elastic foam roller move in the opposite directions at the contact section thereof. Consequently, the toner is transported to the developer carrier from the elastic foam roller in such a manner that the toner is rubbed against the developer carrier, the rubbing force on the toner particle surface increases, and the ability of applying charges produced by friction to the toner is enhanced. Namely, the amount of charges on the toner is increased by the rotations and frictions of the developer carrier and the elastic foam roller. In this structure, therefore, even when the contact depth is small, the toner can be supplied and applied to the developer carrier because of the increased amount of charges and the electrical adhesion force of the toner.

Among the above-mentioned methods, the elastic trailing contact method shown in FIG. 13 applies the lowest pressure to the toner. However, in this method, since the amount of the toner flowing to the contact point Q' is increased, excessive toner passes through between the development roller 51 and the elastic member 52.

On the other hand, in the elastic counter contact method shown in FIG. 14, since the elastic regulating plate 53 for preventing the toner from flowing to the contact point Q' is provided, the amount of toner supplied to the development roller 51 tends to be shorter than a desired amount. Therefore, in the elastic-body-using system, although less pressure is applied to the toner compared to the rigid-body-using system, the stress produced in the peripheral members tends to increase. As a result, such a problem arises that it is difficult to form a toner layer with a uniform thickness.

Furthermore, the uniformity of the thickness of the toner layer in the axis direction of the development roller 51 is higher in the elastic-body-using system than in the rigid-body-using system. However, when the elastic member 52 and the elastic regulating plate 53 are not positioned with high precision, the length (protrusion) from the contact point Q' of the elastic member 52 or the elastic regulating plate 53 to the free end, and the amount of displacement set for the elastic member 52 or the elastic regulating plate 53 vary. Thus, the structure of the elastic-body-using system suffers from a problem that the absolute value of the charge of the toner or the thickness of the toner layer easily changes.

FIG. 17 shows the ratio of the surface potential of the toner layer in the axis direction of the development roller 51 (see FIGS. 15 and 16) to the maximum electric potential (hereinafter just referred to as the "potential ratio) when the thickness of the toner layer is regulated using the elastic bar 54 (see FIG. 15) and the friction-type charging roller 55 (see FIG. 16). In FIG. 17, the curve b1 corresponds to the elastic bar 54, and the curve b2 corresponds to the friction-type charging roller 55.

When the rigid bar 54 is used, the force for regulating the toner layer decreases at the center of the development roller 51 in the axis direction (hereinafter referred to as the roller center). This would be caused by a flexure of the development roller 51 which is produced when the rigid bar 54 is pressed against the development roller 51. As a result, the thickness of the toner layer increases at the roller center, and the potential ratio becomes higher at the roller center as shown by the curve b1 of FIG. 17.

On the other hand, when the friction-type charging roller 55 is used, the force for regulating the toner layer becomes weaker at the ends of the surface of the development roller 51 in the axis direction (hereinafter referred to as the roller ends).

This would be caused by poor setting precision of the development roller 51 and the friction-type charging roller 55, i.e., the axis of the development roller 51 and the axis of the friction-type charging roller 55 are not level with each other. Consequently, the thickness of the toner layer increases at the roller ends, and the potential ratio becomes higher at th e roller ends as shown by the curve b2 of FIG. 17.

Thus, in the rigid-body-using system, if flexure of the members is produced or the setting precision of the respective members is low, the thickness of the toner layer formed on the development roller 51 varies. Such a problem is solved by forming the rigid bar 54 and the friction-type charging roller 55 by highly rigid members with sufficient flatness or cylindricity, and positioning these members with high precision. However, in actuality, it is difficult to position these members with high precision. Consequently, there is a problem that it is difficult to form the toner layer with a uniform thickness along the axis direction of the development roller 51.

Since the above-mentioned rigid-body-using system uses a rigid body as the toner layer thickness regulating member, it has a longer life compared to the elastic-body-using system. However, since the rigid-body-using system applies high pressure to the toner, it causes toner filming. It is thus difficult to certainly retain the life of the toner.

In order to prevent toner filming, various attempts have been made. In these attempts, toner is formed by a resin which has an excellent crushable property and is hard to set so as to, for example, increase the glass transition temperature Tg to a sufficiently high temperature, increase the particle diameter of the toner particles, or decrease the ratio of fine powder. However, toner with a high glass transition temperature Tg does not have good adhesiveness, and toner with a large particle diameter tends to degrade the image quality. Hence, the above-mentioned rigid-body-using system suffers from such problems that it is impossible to surely prevent the filming of the toner and certainly retain the life of the toner.

Additionally, in the structure disclosed in Japanese Publication of Examined Patent Application No. 16025/1991 (Tokukohei 3-16025), since the equalizing member comes into contact with the developer carrier while rotating in a direction opposite to the developer carrier, it is necessary to keep a sufficient contact depth and increase the toner application pressure in order to feed a sufficient amount of toner to the developer carrier. As a result, a compressive force is always exerted on the toner at the contact section, and filming of the toner occurs when the toner is used over a long period of time.

On the other hand, in the structure disclosed in Japanese Publication of Examined Patent Application No. 16210/1994 (Tokukohei 6-16210), since the elastic foam roller and the developer carrier are rotated in the same direction, the searing force acting on the toner becomes higher as the rubbing force exerted on the toner increases. Consequently, when the toner is used over a long period of time, a charge control agent and a superplasticizer which are added to the toner are separated.

Therefore, in a developing device using a non-magnetic one-component toner, in order to prevent the above-mentioned problems, it is preferred to dispose the developer carrier out of contact with the toner supply member like the equalizing member or elastic foam roller. However, in this case, when performing a low-speed development in which the developer carrier moves at a low speed, the supply of toner is carried out to follow the movement of the developer carrier. On the other hand, in a high-speed development, the supply of toner is not performed to follow a high speed movement of the developer carrier. As a result, a shortage of toner supply occurs, and therefore good development cannot be carried out.

SUMMARY OF THE INVENTION

In order to solve the above problems, it is a first object of the present invention to provide a developing device capable of simultaneously reducing the stress produced in peripheral members and the compressing force to toner and charging the toner by sufficient friction.

It is a second object of the present invention to provide a developing device capable of improving particularly the uniformity of the thickness of a toner layer in the direction of the rotating axis of a developer carrier and the uniformity of the charging of the toner as compared to conventional structures.

It is a third object of the present invention to provide a developing device capable of supplying and applying certainly a sufficient amount of toner to the developer carrier even in high-speed development.

In order to achieve the first and second objects, a developing device according to the present invention includes: a developer carrier for carrying a one-component developer on a surface thereof; a developer supply member for supplying the developer to the developer carrier; and a developer charging and application regulating member which comes into contact with the developer carrier, charges the one-component developer to be supplied to the developer carrier, and applies the developer to the developer carrier while regulating a thickness of a layer of the developer. The developer charging and application regulating member is a first flat spring having a plurality of first flat-plate parts including a first contact flat-plate part which comes into contact with the developer carrier, and a first curved part with which the first flat-plate parts are connected to each other.

In this structure, when the one-component developer is supplied to the developer carrier by the developer supply member, the developer is carried by the developer carrier. At this time, the developer is charged by the developer charging and application regulating member provided in contact with the developer carrier, and applied to the developer carrier while being regulated in its thickness.

Meanwhile, since the developer is always rubbed between the developer charging and application regulating member and the developer carrier and between the developer supply member and the developer carrier, a great stress is applied to the developer. Moreover, since the developer charging and application regulating member and the toner supply member work hard in a state of being, for example, pressed against the developer carrier, they are likely to deteriorate. Therefore, in order to maintain good development properties over a long period of time and increase the life of the developing device employing the one-component development system, it is necessary to adopt a mechanism for charging the developer, forming a thin layer of the developer and supplying the developer under a low pressure, and a mechanism for reducing the stress exerted on the peripheral members.

In the above-mentioned structure, the developer charging and application regulating member is formed by a first flat spring having a plurality of first flat-plate parts including the first contact flat-plate part, and which comes into contact with the development carrier, and the first curved part with which the first flat-plate parts are connected to each other. Thus, the above-mentioned mechanisms can be easily realized. Namely, with the above-mentioned structure, various types of developer charging and application regulating members with different properties can be easily obtained by, for example, setting the dimensional parameters such as the radius of the curved part and the width of the flat-plate parts to desired values. In short, the degree of freedom in designing the developer charging and application regulating member is high compared to a conventional structure in which the developer charging and application regulating member is formed by a flat-plate-like flat spring with elasticity and a sleeve or roller having rigidity.

Accordingly, in the above-mentioned structure, for example, the stress to the developer and the stress to the members can be easily decreased with a design of the developer charging and application regulating member. Thus, it is possible to obtain an optimum developer charging and application regulating member, form a developer layer with a uniform thickness particularly along the axis direction of the developer carrier, and maintain a uniform amount of charges on the developer.

For example, when the developer is a magnetic one-component developer, since the developer layer rises, the developer is not likely to condense. On the other hand, when the developer is, for example, a non-magnetic one-component developer, the developer layer is a dense thin layer. Therefore, the developer is likely to condense.

However, even when the developer is such a non-magnetic one-component toner, troubles such as the condensation and filming of the developer can be avoided by preventing the packing density of the developer from becoming too high by adopting the above-mentioned design. As a result, good development properties can be maintained over a long period of time.

In the above-mentioned developing device, it is preferred that the developer carrier is mounted to be rotatable, and the developer charging and application regulating member is arranged so that the first curved part connected to the first contact flat-plate part is placed on a downstream side of the contact point of the developer charging and application regulating member and the developer carrier with respect to the rotating direction of the developer carrier. Moreover, two opening spaces are formed between the contact flat-plate part and the developer carrier, and the open space formed on an upstream side with respect to the rotating direction of the developer carrier is larger than the open space located on a downstream side.

In this structure, the developer which is to be charged and regulated is retained in a sufficient amount in the open space on the upstream side. Only the lowest part of the developer layer, adjoining to the developer carrier, is transported in a necessary amount by a rotation of the developer carrier.

Meanwhile, if the developer is a non-magnetic one-component toner, the developer cannot be transported by magnetic forces. Therefore, only the frictional force and the electrostatic force acting between the developer and the developer carrier can transport the developer. As a result, a shortage of toner supply to the developer carrier tends to occur.

However, in the above-mentioned structure, since the supply of the developer is ensured in the above-mentioned manner, a shortage of the supply of developer to the developer carrier can never occur. Accordingly, in this structure, it is possible to efficiently charge the developer, regulate the thickness of the developer layer, and apply the developer, thereby achieving good development.

Moreover, the developer charging and application regulating member may have a plurality of curved parts. In this structure, it is possible to decrease the overall spring constant of the developer charging and application regulating member.

As a result, even if the developer charging and application regulating member is displaced due to various erroneous factors, such as the installation error in the axis direction and eccentricity of the development roller, the pressing force of the developer charging and application regulating member with respect to the developer on the developer carrier can hardly change, thereby realizing stable formation of the developer layer.

In order to achieve the third object, a developing device of the present invention is based on the above-mentioned developing device. The developer carrier is mounted to be rotatable a and a developer powder pressure control member for controlling the powder pressure of the developer to be supplied to the developer carrier from the developer supply member is disposed at a position which is on a downstream side of the developer supply member but is on an upstream side of the developer charging and application regulating member with respect to the rotating direction of the developer carrier.

In this structure, the powder pressure of the developer which varies with the supply operation of the developer supply member is kept uniform by the toner powder pressure control member, and a predetermined application pressure is applied to the developer carrier. Thus, in the conventional structure, in order to certainly supply and apply the developer to the developer carrier, the application pressure is set high by pressing the developer supply member deep into the developer carrier. However, in the above-mentioned structure, there is no need to increase the application pressure by such an arrangement.

Hence, in this structure, even if the developer supply member and the developer carrier are disposed out of contact with each other, the developer pressure control member applies a predetermined powder pressure to the developer which is to be supplied to the developer carrier. Consequently, for example, in high-speed development in which the developer carrier moves at a high speed, the supply of the developer follows the high-speed movement. It is therefore possible to prevent a shortage of the supply of the developer to the developer carrier. In short, in this structure, even if these members are disposed out of contact with each other, it is possible to stably supply the developer to the developer carrier irrespectively of the developing speed.

Furthermore, it is preferred that the developer powder pressure control member is a second flat spring including a plurality of second flat-plate parts, and a second curved part with which the second flat-plate parts are connected to each other.

In this structure, the degree of freedom in designing the developer powder pressure control member increases. Namely, for example, various types of developer powder pressure control members with different properties can be easily obtained by, for example, setting the dimensional parameters, such as the radius of the curved part and the width of the flat-plate parts, to desired values. Accordingly, in this structure, for example, it is possible to easily reduce the stress to the developer and the stress to the members with a design of the developer powder pressure control member. Consequently, it is possible to obtain an optimum developer powder pressure control member, and maintain good development properties.

Additionally, it is preferred that a part of the developer powder pressure control member is in contact with the developer carrier. In this structure, the developer to be supplied to the developer carrier is rubbed between the developer carrier and the developer powder pressure control member. As a result, the ability to apply charges to the developer by friction increases. Therefore, in this structure, it is possible to increase the ability to charge the developer by friction.

Moreover, it is preferred that the developer powder pressure control member is arranged so that the second curved part is located on a downstream side of the contact point of the developer powder pressure control member and the developer carrier with respect to the rotating direction of the developer carrier. It is also preferred that two open spaces are formed between the developer powder pressure control member and the developer carrier so that the open space formed on an upstream side with respect to the rotating direction of the developer carrier is larger than an open space formed on a downstream side.

In this structure, the developer which is to be charged and regulated by the developer charging and application regulating member is retained in a sufficient amount in the open space on the upstream side. Furthermore, only the lowest part of the developer layer, adjoining the developer carrier, is transported in a necessary amount by a movement of the developer carrier.

Namely, in the above-mentioned structure, before the developer charging and application regulating member ensures the supply of the developer to regulate the thickness of the developer layer, the developer powder pressure control member located on the upstream side of the developer charging and application regulating member with respect to the rotating direction of the developer carrier ensures the supply of the developer to a certain degree and then regulates the thickness of the developer layer. As a result, the burden of the developer charging and application member is significantly reduced. In this structure, therefore, it is possible to increase the life of the developer charging and application regulating member, and achieve more efficient charging and application of the developer and regulation of the developer layer thickness. Consequently, good development is certainly performed.

The developer powder pressure control member may have a plurality of curved parts. In this structure, it is possible to decrease the overall spring constant of the developer powder pressure control member.

Furthermore, it is preferred to attach a rubber-type elastic body having rubber-like elasticity, such as silicone rubber and urethane rubber, to a surface of the first contact flat-plate part, which comes into contact with the developer carrier.

With this arrangement, errors such as a crease and undulation of the surface of the developer charging and application regulating member which were produced in forming the curved part by bending and an error in respect to the precision of the setting position of the developer charging and application regulating member can be accommodated by the elastic body and surely eliminated. It is therefore possible to suppress the effect of external factors such as a crease and undulation caused in the developer charging and application regulating member, and certainly achieve a uniform nip width. In addition, it is possible to relax the precision required for the design and positioning of the developer charging and application regulating member.

Furthermore, it is preferred to use a non-magnetic one-component developer for the developer. When the developer is a non-magnetic one-component developer, excellent stability in charging and a higher charging ability are achieved as compared to the magnetic one-component developer. It is thus possible to obtain good development properties.

For a fuller understanding of the nature and advantages of the invention, reference should be made to the ensuing detailed description taken in conjunction with the accompanying drawings.

DESCRIPTION OF PREFERRED EMBODIMENTS

Embodiment 1

The following description will explain one embodiment of the present invention with reference to FIGS. 1 to 4.

Figure 2:
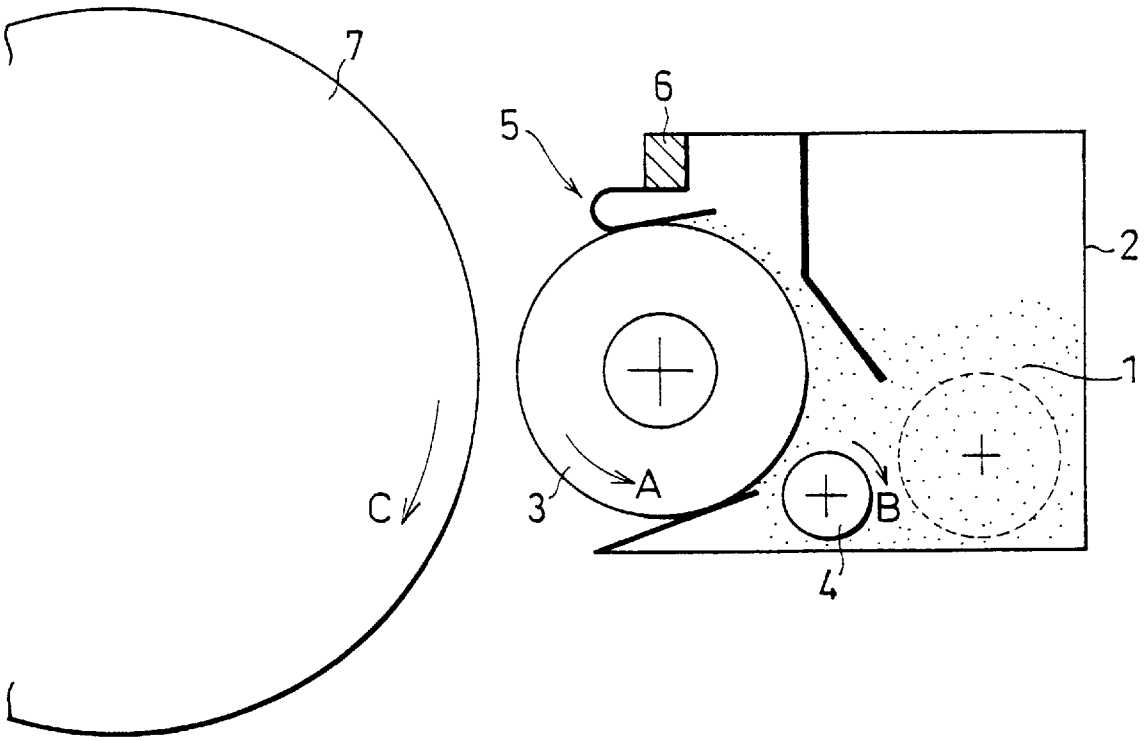
FIG. 2 is a sectional view showing the schematic structure of the developing device.

As illustrated in FIG. 2, a developing device of this embodiment includes a developer tank 2 having an opening section as a casing for storing toner (one-component developer) 1. One example of the toner 1 is a non-magnetic one-component developer with an average particle diameter of 7.5 $\mu$m, which is produced by adding carbon black, silica, and a charge control agent to a styrene acrylic resin (copolymer of styrene and acrylic acid ester). The non-magnetic one-component developer shows better charging stability compared to a magnetic one-component developer, and thus has a high charging ability. Therefore, if the non-magnetic one-component developer is used as the toner 1, it is possible to obtain improved development properties as compared to the use of the magnetic one-component developer.

In the opening section of the developer tank 2, a development roller (developer carrier) 3 is disposed so as to substantially close the opening section. The development roller 3 carries the supplied toner 1 on its surface, and transports the toner 1 to an electrostatic latent image holder 7, to be described later, by its rotation.

The development roller 3 is formed by, for example, an aluminum development sleeve. The surface of the development sleeve is roughened with spherical beads so that a center line average surface roughness Ra defined by JIS (Japanese Industrial Standards) B 0601 is 1 $\mu$m. The development roller 3 is rotatable in a counterclockwise direction (the direction of the arrow A in FIG. 2), and supported by the developer tank 2.

Inside of the developer tank 2, a toner supply roller (developer supply member) 4 is disposed at an upstream position with respect to the rotating direction of the development roller 3. The toner supply roller 4 supplies the toner 1 to the development roller 3 by its rotation in the direction opposite to the rotating direction the development roller 3, i.e., in a clockwise direction (the direction of the arrow B in FIG. 2). Although the toner supply roller 4 is out of contact with the development roller 3 in FIG. 2, it can be disposed in contact with the development roller 3. The toner supply roller 4 is also supported by the developer tank 2.

Inside of the developer tank 2, a U-shaped spring (first flat spring) 5 is placed at a position which is on the downstream side of the toner supply roller 4 but on the upstream side of the electrostatic image holder 7 with respect to the rotating direction of the development roller 3. The U-shaped spring 5 comes into contact with the development roller 3, charges the toner 1 to be supplied to the development roller 3, and applies the toner 1 to the development roller 3 while regulating the thickness of a layer of the toner 1. Namely, the U-shaped spring 5 functions as a developer charging and application regulating member defined in the claims. The structure of the U-shaped spring 5 will be described in detail later.

The U-shaped spring 5 is fixed to the developer tank 2 through a support member 6 for supporting the U-shaped spring 5. The support member 6 is preferably a rigid body with sufficiently high natural frequency in order to prevent resonance with the U-shaped spring 5. It is possible to fix one end of the U-shaped spring 5 directly to the developer tank 2 without using the support member 6.

Provided at a position facing the development roller 3 is the electrostatic latent image holder 7 as a photoreceptor drum. The electrostatic latent image holder 7 rotates in the direction opposite to the rotating direction of the development roller 3, i.e., in a clockwise direction (the direction of the arrow C in FIG. 2). The electrostatic latent image holder 7 is exposed and scanned using a laser beam which is modulated according to image information input from a computer (not shown). As a result, a n electrostatic latent image is formed on the electrostatic latent image holder 7. The electrostatic latent image is then developed into a visible image by the toner 1 which has been charged by the developing device.

An electrophotographic apparatus of the present invention includes the developing device, and an electrostatic latent image holder which is provided at a position facing the developing device to hold an electrostatic latent image. For the structures other than the developing device and electrostatic latent image holder in the electrophotographic apparatus, it is possible to adopt structures disclosed in, for example, U.S. Pat. Nos. 5,499,089, 5,508,785, and 5,541,715.

In this embodiment, in order to minimize the stress given to the toner 1, the electrostatic latent image holder 7 and the development roller 3 are disposed with a predetermined gap therebetween. However, even if these members are disposed in contact with each other, it is possible to implement the present invention without any problems.

Next, the structure of the U-shaped string 5 will be described in detail below.

Figure 1:
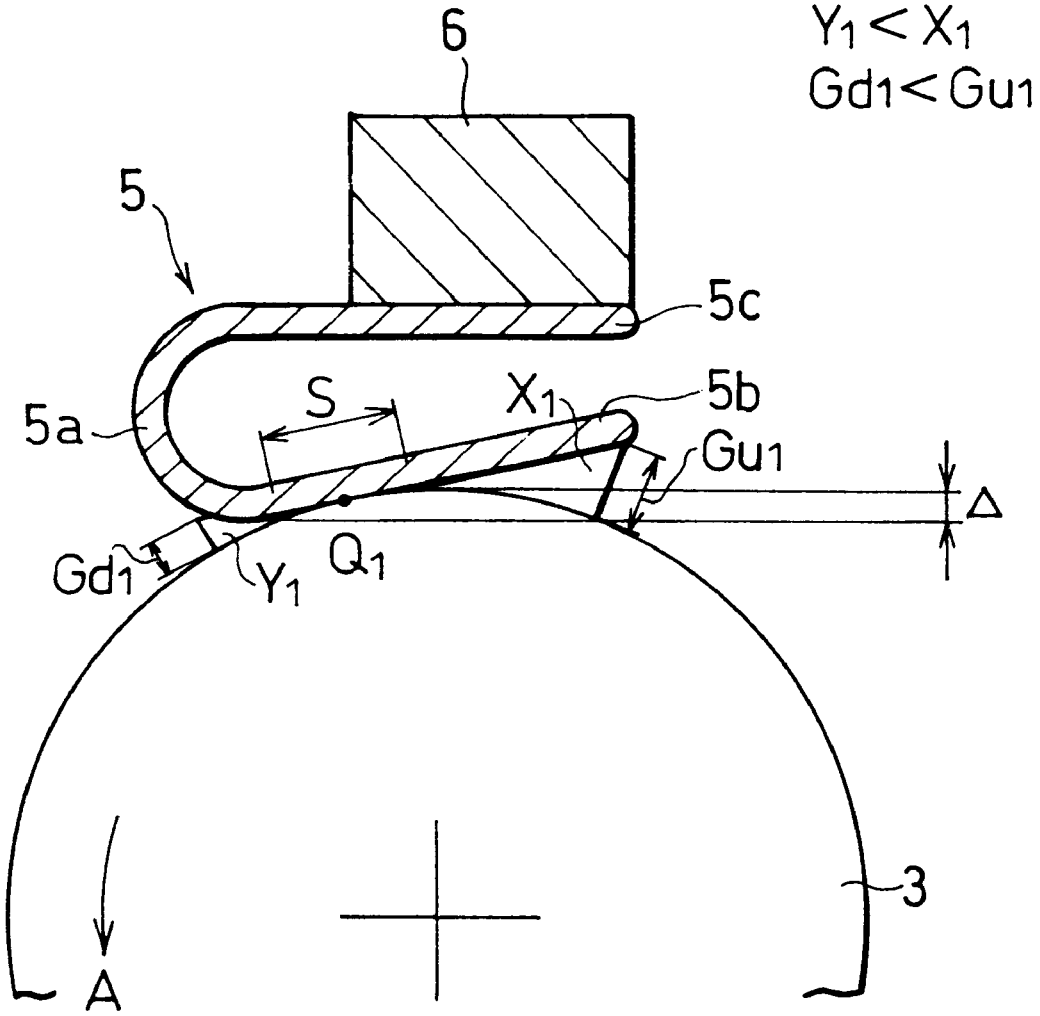
FIG. 1 is a sectional view showing the detailed structure of essential sections of a developing device according to the present invention.

As illustrated in FIG. 1, the U-shaped spring 5 includes one curved part (first curved part) 5*a*, and a contact flat-plate part (first contact flat-plate part) 5*b* and a fixed flat-plate part 5*c* that are connected to the ends of the curved part 5*a*, respectively. In short, the U-shaped spring 5 is formed by the contact flat-plate part 5*b* and fixed flat-plate part 5*c* disposed with a space therebetween, and the curved part 5*a* with which the ends of the contact flat-plate part 5*b* and fixed flat-plate part 5*c* are connected to each other.

Each of the ends of the curved part 5*a* which are connected to the contact flat-plate part 5*b* and fixed flat-plate part 5*c* forms a substantially single plane with the contact flat-plate part 5*b* or the fixed flat-plate part 5*c*. The central angle of the curved part 5*a* is originally set at 180 degrees. However, the central angle becomes greater with deflection of the U-shaped spring 5. Therefore, the distance from the contact flat-plate part 5*b* to the fixed flat-plate part 5*c* increases towards the downstream direction with respect to the rotating direction of the development roller 3.

The U-shaped spring 5 is arranged so that one surface of the contact flat-plate part 5*b* comes into contact with the development roller 3 at a contact point $Q_1$ in the vicinity of its center and presses the development roller 3 over the entire area along the direction of the rotation axis of the development roller 3. The fixed flat-plate part 5*c* of the U-shaped spring 5 is fixed to the developer tank 2 with the support member 6 for supporting the U-shaped spring 5.

In this case, two wedge-shaped open spaces $X_1$ and $Y_1$ are formed between the contact flat-plate part 5*b* of the U-shaped spring 5 and the development roller 3. More specifically, the open space $X_1$ is formed on the upstream side of the contact point $Q_1$ with respect to the rotating direction of the development roller 3, and the open space $Y_1$ is formed on the downstream side.

In this embodiment, the contact flat plate 5*b* is arranged so that the end located on the downstream side with respect to the rotating direction of the development roller 3 is connected to the curved part Sa and that a gap $Gu_1$ between the other end on the upstream side with respect to the rotating direction of the development roller 3 and the surface of the development roller 3 is larger than a gap $Gd_1$ between the end on the downstream side and the surface of the development roller 3.

With this arrangement, in the U-shaped spring 5 of this embodiment, the curved part 5*a* is located on the downstream side of the contact point $Q_1$ with respect to the rotating direction of the development roller 3, and the open space $X_1$ is larger than the open space $Y_1$.

In this structure, the flow of the toner 1 transported by the rotation of the toner supply roller 4 is stemmed by the contact flat-plate part 5*b*, and reserved in the wedge-shaped open space $X_1$ formed between the development roller 3 and the contact flat-plate part 5*b*. At this time, since the toner 1 is successively supplied to the open space $X_1$ by the toner supply roller 4, the powder pressure of the toner 1 in the open space $X_1$ increases. As a result, a force that compresses the U-shaped spring 5 inwards, i.e., a force that compresses the contact flat-plate part 5*b* in the direction opposite to a direction toward which the U-shaped spring 5 presses the development roller 3 (hereinafter referred to the pressing direction), is produced.

Here, the contact flat-plate part 5*b* displaces by an amount $\Delta$ in the opposite direction to the pressing direction, and thus the restoring force about the contact point $Q_1$ acts in the pressing direction due to the elasticity of the curved part 5*a*. Therefore, the toner 1 retained in the open space $X_1$ is not affected by a variation of the powder pressure, and an appropriate amount of the toner 1 is stably transported to a nip section S between the development roller 3 and the U-shaped spring 5. In the nip section S, a nip is ensured over a wide range by the restoring force of the U-shaped spring 5. Consequently, a sufficient amount of frictional charges are given to the transported toner 1 at the nip section S.

Meanwhile, if the toner 1 is a non-magnetic one-component toner, the toner 1 cannot be transported and supplied to the development roller 3 by magnetic forces. Therefore, only the frictional force and the electrostatic force acting between the toner 1 and the development roller 3 can make the toner 1 adhere and transport it to the development roller 3. Thus, a shortage of toner supply to the development roller 3 tends to occur particularly when the toner 1 is non-magnetic one-component toner.

In the above-mentioned structure, since the U-shaped spring 5 is disposed so that the curved part 5*a* is located on the downstream side of the contact point $Q_1$ with respect to the rotating direction of the development roller 3 and that the open space $X_1$ is larger than the open space $Y_1$, the toner 1 which is to be charged and regulated is retained in a sufficient amount in the open spaces $X_1$. Only the lowest part of the toner layer, adjoining the development roller 3, is transported in a necessary amount by a rotation of the development roller 3.

In the above-mentioned structure, it is thus possible to charge the toner 1 while ensuring a supply of the toner 1 using the open space $X_1$ and effectively perform the function of regulating the thickness of the layer of the toner 1 at the contact point $Q_1$, thereby achieving good development.

The material of the U-shaped spring 5 is preferably a metallic elastic material, and more preferably a non-magnetic metallic elastic material. The material of the U-shaped spring 5 can be selected from a wide range of materials including stainless steel (Young modulus of 17,000 kgf/mm$^2$), beryllium (Young modulus of 12,000 kgf/mm$^2$), phosphor bronze (Young modulus of 10,000 kgf/mm$^2$), aluminum (Young modulus of 7,300 kgf/mm$^2$), etc. Moreover, the physical properties of the U-shaped spring 5 such as the modulus of elasticity (Young modulus) are not particularly limited.

Although beryllium and phosphor bronze are used as the materials for typical metallic flat springs, aluminum is not usually used as the material for the metallic flat springs because its strength is not sufficient. However, for the U-shaped spring 5, aluminum can be used suitably because of the stress reducing function. Furthermore, although stainless steel has magnetic properties, it can be used for the U-shaped spring 5.

As described above, the developing device of this embodiment includes the development roller 3 for carrying the toner 1, the toner supply roller 4 for supplying the toner 1 to the development roller 3, and the developer charging and application regulating member which charges the toner 1 to be supplied to the development roller 3 and applies the charged toner 1 to the development roller 3 while regulating the thickness of the layer of the toner 1. The developer charging and application regulating member has at least one curved part 5*a* and a plurality of flat-plate parts 5*b*·5*c* including the contact flat-plate part 5*b* which is in contact with the development roller 3, and the flat-plate parts 5*b*·5*c* are connected to each other with the curved part 5*a* to form the U-shaped spring 5.

In this structure, when the toner 1 is supplied to the development roller 3 by the toner supply roller 4, the toner 1 is carried on the development roller 3. At this time, the developer charging and application regulating member mounted in contact with the development roller 3 charges the toner 1 and applies the charged toner to the development roller 3 while regulating the thickness of the toner layer.

Since the toner 1 is always rubbed between the developer charging and application regulating member and the development roller 3 and between the toner supply roller 4 and the development roller 3, it receives great stress from the above-mentioned peripheral members. Moreover, since the developer charging and application regulating member and the toner supply roller 4 work hard in a state of being pressed against the development roller 3, they are likely to deteriorate. Therefore, in order to maintain good development properties over a long period of time and increase the life of the developing device employing the one-component development system, it is necessary to adopt a mechanism for charging the toner 1, forming a thin layer of the toner 1 and supplying the toner 1 under a low pressure, and a mechanism for reducing the stress exerted on the peripheral members.

In the above-mentioned structure, the developer charging and application regulating member has at least one curved part 5*a* and a plurality of flat-plate parts 5*b*·5*c* including the contact flat-plate part 5*b* which comes into contact with the development roller 3, and the flat-plate parts 5*b*·5*c* are connected to each other with the curved part 5*a* to form the U-shaped spring 5. Thus, the above-mentioned mechanisms can be easily realized.

Namely, with the above-mentioned structure, various types of U-shaped springs with different properties can be easily obtained by, for example, setting the dimensional parameters such as the radius R of the curved part 5*a*, the width b of the flat-plate parts 5*b*·5*c*, the ratio $\lambda$ of the length of the flat-plate parts 5*b*·5*c* to the length of the curved part 5*a* (to be described later) to desired values. In short, the degree of freedom in designing the developer charging and application regulating member is high compared to a conventional structure in which the developer charging and application regulating member is formed by a flat-plate-like flat spring with elasticity and a rod or roller having rigidity.

Accordingly, in the above-mentioned structure, for example, the stress to the toner 1 and the stress to the members can be decreased easily by varying the design of the U-shaped spring 5. Thus, it is possible to obtain an optimum U-shaped spring 5, form a toner layer with a uniform thickness particularly along the axis direction of the development roller 3, and maintain a uniform amount of charges on the toner 1.

Moreover, when the toner 1 is, for example, a magnetic one-component toner, since the toner layer rises, the toner is not likely to condense. On the other hand, when the toner 1 is, for example, a non-magnetic one-component toner, the toner layer is a dense thin layer. Therefore, the toner 1 is likely to condense. However, even when the toner 1 is such a non-magnetic one-component toner, troubles such as the condensation and filming of the toner 1 can be avoided by preventing the packing density of the toner 1 from becoming too high by adopting the above-mentioned design. As a result, good development properties can be maintained over a long period of time.

Figure 3:
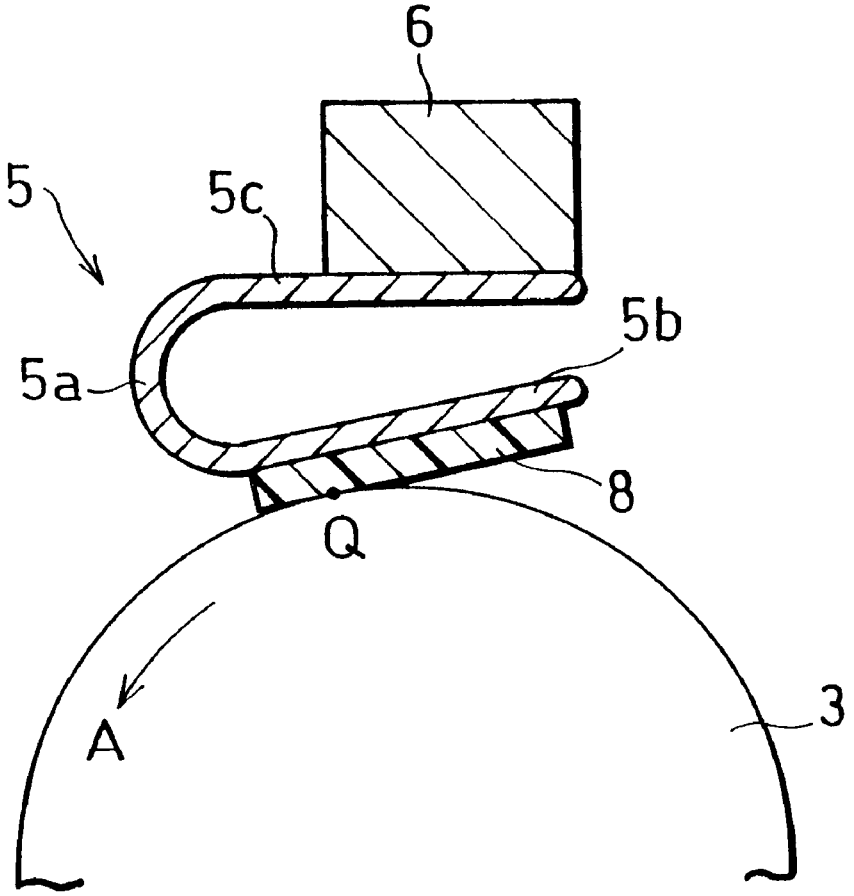
FIG. 3 is a sectional view showing an example in which a rubber-type elastic body is attached to a U-shaped spring.

In this embodiment, the contact flat-plate part 5*b* of the U-shaped spring 5 is in direct contact with the development roller 3. However, as shown in FIG. 3, it is possible to attach a flat-plate-like rubber-type elastic body 8 (elastic body) having rubber-like elasticity made of silicone rubber, urethane rubber, or the like to a surface of the contact flat-plate part 5*b* which comes into contact with the development roller 3, and bring the rubber-type elastic body 8 into contact with the development roller 3.

When forming the curved part 5*a* by, for example, bending, the surface of the U-shaped spring 5 usually becomes uneven due to a crease, undulation, etc. However, by attaching the rubber-type elastic body 8 to the development roller 3, the unevenness (error) caused by the crease, undulation, etc. can be accommodated by the rubber-type elastic body 8 and surely eliminated. Moreover, even if there is a slight error in the precision of positioning the U-shaped spring 5, the error is accommodated by the rubber-type elastic body 8 and certainly eliminated like the above. In this case, it is therefore possible to certainly equalize the nip width by suppressing the effect of the displacement and unevenness such as the crease and undulation of the U-shaped spring 5 that are the causes of a variation in the nip width. Furthermore, it is possible to relax the precision required for the design and the setting position of the U-shaped spring 5.

In this embodiment, the first flat spring is the U-shaped spring 5 formed by one curved part 5*a*, and the contact flat-plate part 5*b* and fixed flat-plate part 5*c* that are connected to the ends of the curved part 5*a*, respectively. However, the first flat spring of the present invention is not necessarily limited to this structure. Namely, the first flat spring of the present invention needs to have a plurality of flat-plate parts including a contact flat-plate part which comes into contact with the development roller 3, and at least one curved part with which the flat-plate parts are connected to each other.

Figure 4:
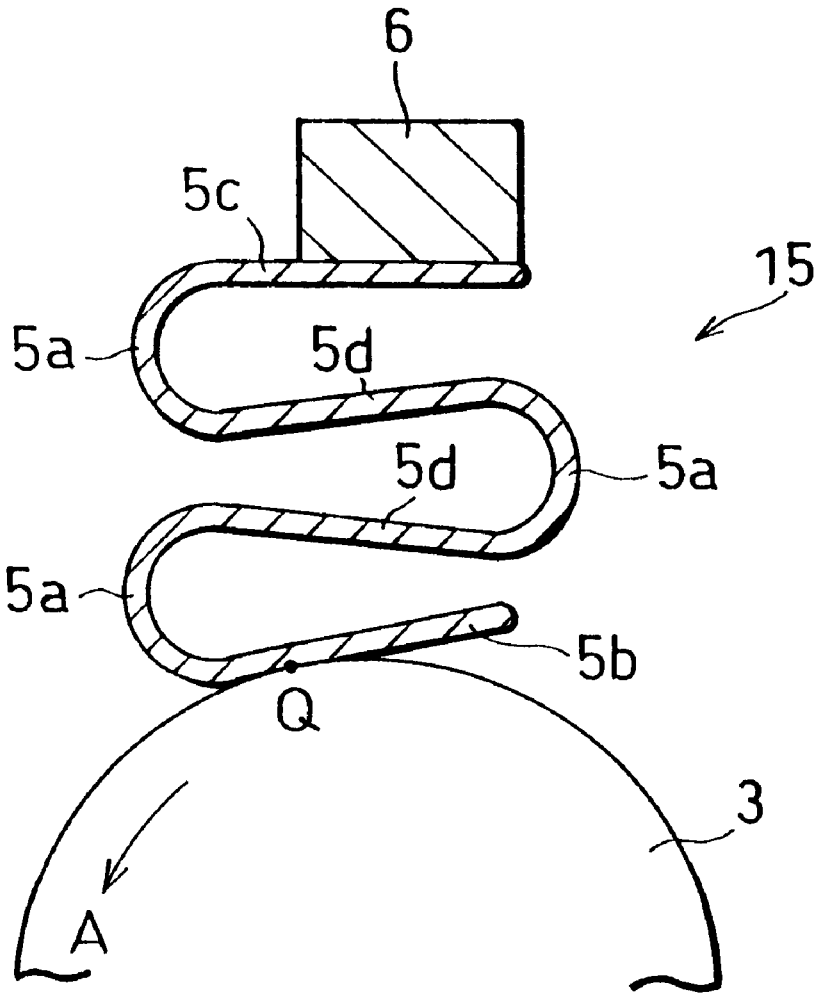
FIG. 4 is a sectional view showing an example of the structure in which a flat spring with curved part includes a plurality of curved parts and flat-plate parts.

It is therefore possible to use a flat spring 15 with curved part in place of the U-shaped spring 5 of this embodiment. As illustrated in FIG. 4, the flat spring 15 with curved part is formed by a plurality of curved parts 5*a*, and a plurality of flat-plate parts 5*b*·5*c*·5*d* including the contact flat-plate part 5*b* which comes into contact with the development roller 3. In the structure of the flat spring 15 with curved part, the flat-plate parts 5*b*·5*c*·5*d* and the curved parts 5*a* are positioned alternately, and the flat-plate parts 5*b*·5*c*·5*d* are connected to each other with the curved parts 5*a*. More specifically, the flat spring 15 with curved part includes the contact flat-plate part 5*b* which comes into contact with the development roller 3, the fixed flat-plate part 5*c* which is fixed to the developer tank 2 through the support member 6, and two free flat-plate parts 5*d* which are not fixed. The flat spring 15 arranged so that the flat-plate parts 5*b*·5*c*·5*d* are connected to each other at each end through the curved parts 5*a*.

In this structure, in addition to the effect of this embodiment, the overall spring constant of the first flat spring can be decreased because the flat spring 15 with curved part has a plurality of curved parts 5*a*.

More specifically, the force F of the first flat spring like the flat plate 5 and flat plate 15 is given by $$F=k\cdot x$$

where x is the displacement of the first flat spring (displacement of the contact flat-plate part 5*b*), and k is the spring constant of the first flat spring. The displacement x of the first flat spring causes a variation in Δx due to various erroneous factors, such as the installation error in the axis direction and eccentricity of the development roller. In this case, the variation ΔF of the force is given by $$\Delta F=k\cdot\Delta x.$$

Thus, the variation ΔF of the force proportional to the spring constant k is caused by the variation Δx. When the spring constant k is small, the force F becomes insensitive to the variation Δx, thereby enabling stable formation of a developer layer.

In this case, it is also possible to attach the above-mentioned rubber-type elastic body 8 (see FIG. 3) to a surface of the contact flat-plate part 5*b* that comes into contact with the development roller 3, and bring the rubber-type elastic body 8 into contact with the development roller 3. As a result, needless to say, the same effect as that produced by the above-mentioned structure is obtained.

Embodiment 2

The following description will explain another embodiment of the present invention with reference to FIGS. 5, 6, 7, 18 and 19. The members having the same function as those of Embodiment 1 will be designated with the same reference numbers, and the explanation thereof will be omitted. The explanation of the same structure as that of Embodiment 1 will also be omitted.

As the method for supplying toner to the developer carrier, a method using a toner supply member made of an elastic body to supply toner to the developer carrier while imparting frictional charges to the toner by rubbing the toner supply member and the developer carrier together is usually employed. However, in such a method, the stress applied to the toner is high, and the image quality deteriorates when the toner is used for a long period of time as mentioned above.

In order to reduce the stress to the toner, it is desired that the toner supply member is disposed out of contact with the developer carrier. In this case, however, although the stress to the toner is certainly reduced, the efficiency of imparting charges to the toner and the efficiency of supplying and applying the toner to the developer carrier are lowered.

In the structure of Embodiment 1 in which the toner supply roller 4 and the development roller 3 are disposed out of contact with each other, the supply of a necessary amount of toner is ensured by optimizing the wedge-shaped open spaces $X_1 \cdot Y_1$ formed between the U-shaped spring 5 and the development roller 3. However, during high-speed development in which the development roller 3 rotates at a speed, for example, not lower than 100 mm/sec., the ability to supply the toner to the development roller 3 is insufficient.

Figure 5:
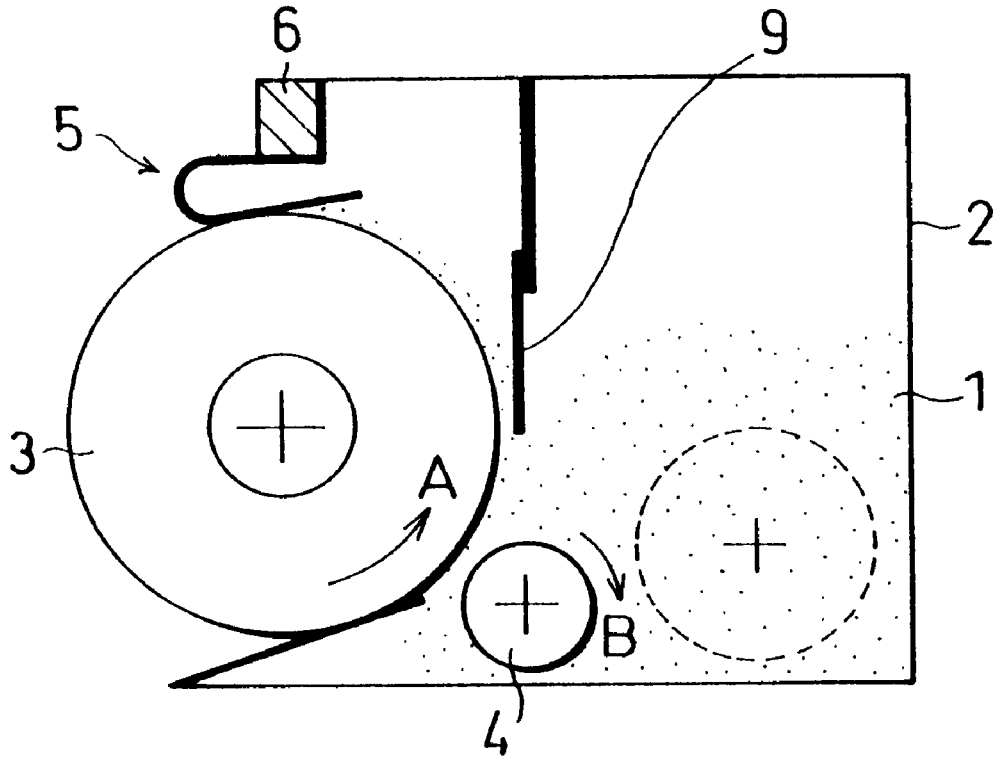
FIG. 5 is a sectional view showing an example in which the developing device is provided with a toner powder pressure control member.

Therefore, in this embodiment, as illustrated in FIG. 5, a toner powder pressure control member 9 (developer powder pressure control member) for controlling the powder pressure of the toner 1 is provided at a position which is on the downstream side of the toner supply roller 4 but is on the upstream side of the U-shaped spring 5 with respect to the rotating direction of the development roller 3. One end of the toner powder pressure control member 9 is fixed to the developer tank 2, and the opposite end is a free end. Namely, the toner power pressure control member 9 is a so-called beam of cantilever design.

The toner powder pressure control member 9 is formed by, for example, a flat-plate-like flat spring made of an elastic body. The toner powder pressure control member 9 applies a predetermined application pressure to the development roller 3 while keeping the powder pressure of the toner 1 that varies according the supply of the toner to the development member 3 at a uniform value.

In this structure, the toner 1 is supplied to the development roller 3 as the toner supply roller 4 rotates. At this time, the powder pressure of the toner 1 supplied to the development roller 3 is kept uniform by the toner powder pressure control member 9, and a predetermined application pressure is applied to the development roller 3. The toner applied to the development roller 3 at the predetermined application pressure is then charged by friction with the U-shaped spring 5 when the development roller 3 rotates, and regulated to form a layer of a uniform thickness.

When the developing device of this embodiment was operated for a long period of time, the toner 1 did not stick to the periphery of the development roller 3 or condense. It is thus considered that, in the developing device of this embodiment, the powder pressure of the toner 1 supplied to the development roller 3 is reduced as compared to a conventional structure using an application means of rotation rubbing type.

Moreover, in this structure, the toner powder pressure control member 9 for controlling the toner powder pressure is disposed at a position which is on the downstream side of the toner supply roller 4 but on the upstream side of the U-shaped spring 5 with respect to the rotating direction of the development roller 3. In this structure, even if the toner supply roller 4 and the development roller 3 are disposed out of contact with each other, a predetermined powder pressure is given to the toner 1 supplied to the development roller 3 by the toner powder pressure control member 9. As a result, even when high-speed development in which the development roller 3 rotates at a speed as high as, for example, a peripheral speed of 100 mm/sec. is performed, the toner 1 follows the high speed rotation of the development roller 3 and is surely supplied to the development roller 3.

Namely, in the conventional structure, in order to certainly supply and apply the toner 1 to the development roller 3, the application pressure is set high by pressing the toner supply roller 4 deep into the development roller 3. However, in the above-mentioned structure, there is no need to increase the application pressure by such an arrangement. Thus, in this structure, even if the toner supply roller 4 and the development roller 3 are disposed out of contact with each other, the supply of the toner 1 to the development roller 3 can be stably performed irrespectively of the developing speed. It is therefore possible to achieve good development even in, for example, high development.

Figure 6:
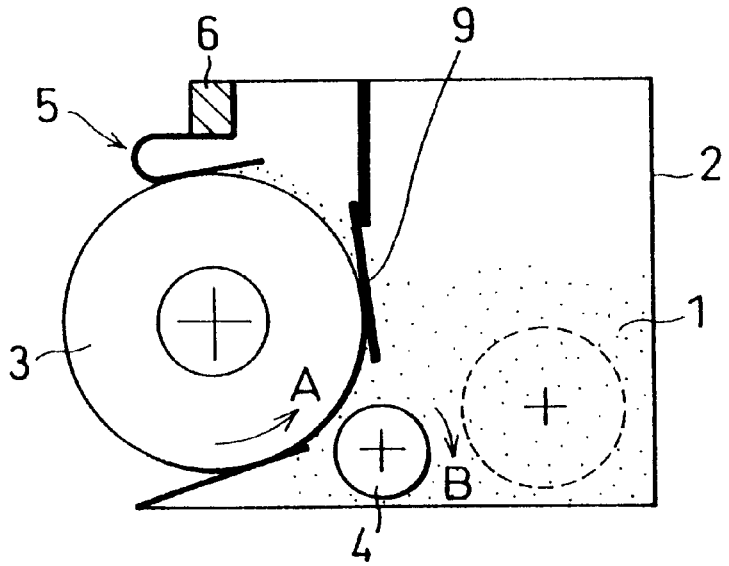
FIG. 6 is a sectional view showing an example in which the toner powder pressure control member is disposed in contact with a development roller.

In this embodiment, the toner powder pressure control member 9 and the development roller 3 are disposed out of contact with each other. However, as shown in FIG. 6, it is possible to dispose the toner powder pressure control member 9 to come into contact with the development roller 3. Considering the stress applied to the toner 1, these members are preferably out of contact with each other. However, if these members are arranged to be in contact with each other, the amount of frictional charges given to the toner 1 increases. In this case, therefore, the charging of the toner by friction is facilitated.

Figure 7:
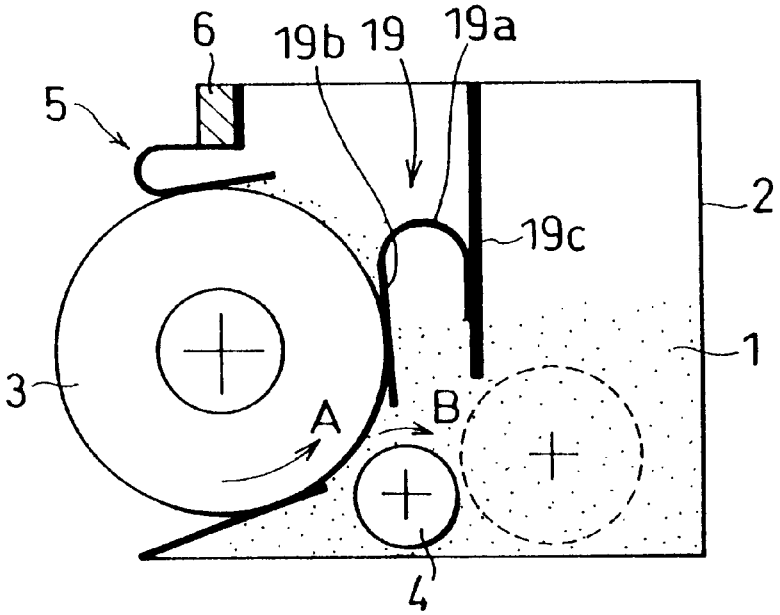
FIG. 7 is a sectional view showing an example in which the toner powder pressure control member includes the structure of a flat spring with curved part.

Moreover, in this embodiment, the toner powder pressure control member formed by a flat-plate-like flat spring is used as the developer powder pressure control member. However, it is possible to obtain the same effect as above by using a toner powder pressure control member (second flat spring) 19 formed by a flat spring with a curved part. As shown in FIG. 7, the toner powder pressure control member 19 includes at least one curved part (second curved part) 19*a* and a plurality of flat-plate parts (second flat-plate parts) 19*b*·19*c* including a contact flat-plate part (second flat-plate part) 19*b* which comes into contact with the development roller 3. In the toner powder pressure control member 19, the flat-plate parts 19*b*·19*c* are connected to each other with the curved part 19*a*.

In short, when the toner powder pressure control member 19 shown in FIG. 7 is used as the developer powder pressure control member, the degree of freedom in designing the developer powder pressure control member increases. Namely, various types of toner powder pressure control members 19 with different properties can be easily obtained by, for example, setting the dimensional parameters, such as the radius of the curved part 19*a* and the width of the flat-plate parts 19*b*·19*c*, to desired values. Accordingly, in this structure, for example, it is possible to easily reduce the stress to the toner 1 and the stress to the members by varying the design of the toner powder pressure control member 19. Consequently, it is possible to obtain an optimum toner powder pressure control member 19, and maintain good development properties. Meanwhile, the flat-plate part 19*c* which does not make contact with the development roller 3 is fixed to the developer tank 2.

Figure 18:
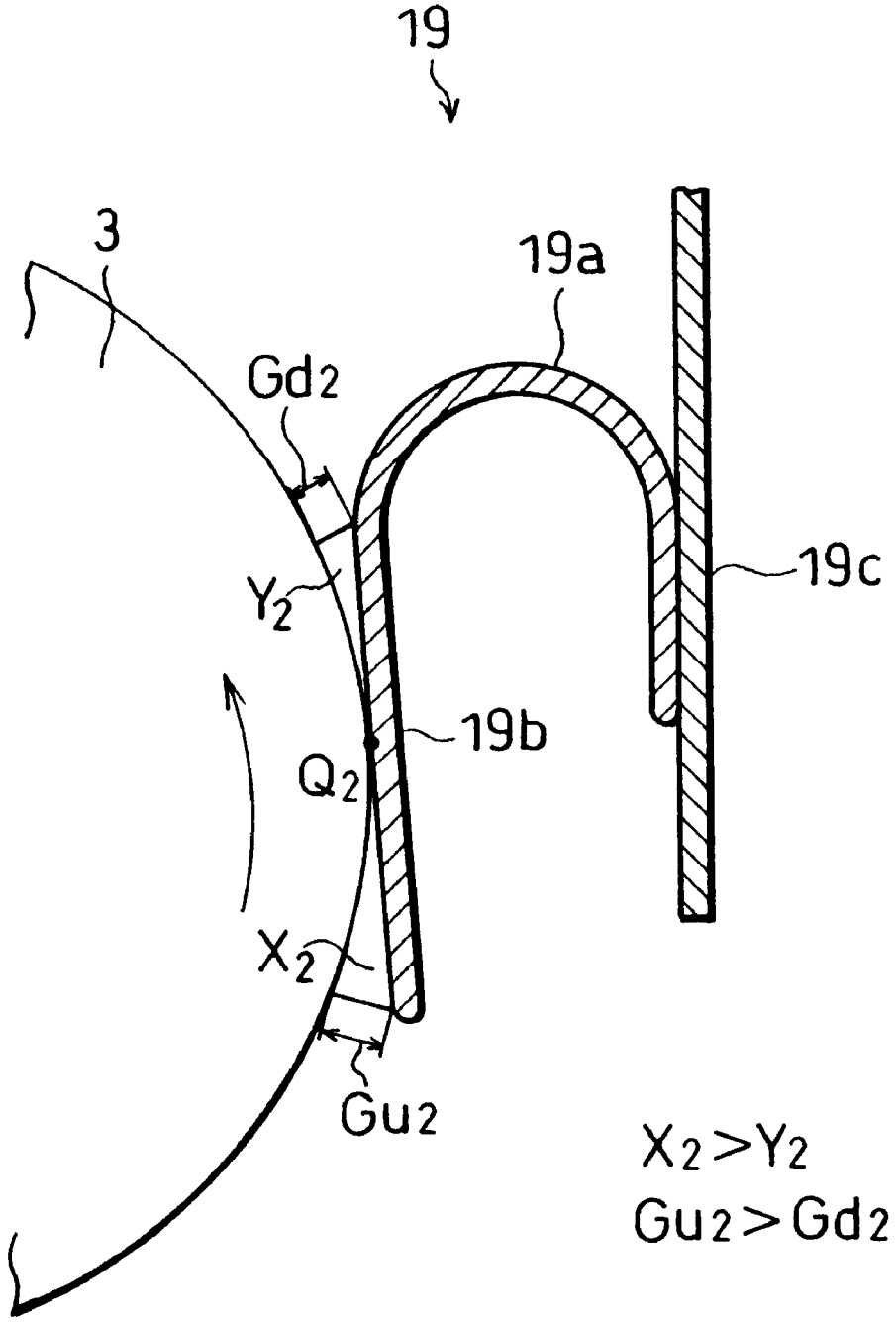
FIG. 18 is an enlarged sectional view of the toner powder pressure control member shown in FIG. 7.

Moreover, as illustrated in FIG. 18, if the toner powder pressure control member 19 comes into contact with the development roller 3 so that the curved part 19*a* is located on the downstream side of a contact point $Q_2$ between the toner powder pressure control member 19 and the development roller 3 with respect to the rotating direction of the development roller 3 and so that one of the two open spaces formed between the toner powder pressure control member 19 and the development member 3, namely, the open space $X_2$ at an upstream position with respect to the rotating direction of the development roller 3, is larger than the open space $Y_1$ at a downstream position, the following functions and effects are produced.

Namely, the toner 1 which is to be charged and regulated by the U-shaped spring 5 is retained in sufficient amount in the open space $X_2$ at the upstream position with respect to the rotating direction of the development roller 3. Then, only the lowest part of the toner layer adjoining to the development roller 3 is transported by a necessary amount with a rotation of the development roller 3.

Shortly, in the above-mentioned structure, before the U-shaped spring 5 ensures the supply of the toner 1 to regulate the toner layer thickness, the toner powder pressure control member 19 located on the upstream side of the U-shaped spring 5 with respect to the rotating direction of the development roller 3 ensures the supply of the toner 1 to a certain degree and then regulates the thickness of the toner layer. As a result, the burden of the U-shaped spring 5 is significantly reduced.

In this structure, therefore, it is possible to increase the life of the U-shaped spring 5, and achieve more efficient charging and application of the toner 1 and regulation of the toner layer thickness. Consequently, good development is certainly performed.

In order to realize the above-mentioned structure, it is necessary to dispose the flat-plate part so that the curved part 19*a* is connected to one end of the contact flat-plate part 19*b* which is located at the downstream position with respect to the rotating direction of the development roller 3 and so that a gap $Gu_2$ between the developer carrier surface and the other end at the upstream position with respect to the rotating direction of the development roller 3 is larger than a gap $Gd_2$ formed between the end at the downstream position and the development roller 3.

Furthermore, in the embodiment shown in FIG. 7, the toner powder pressure control member 19 formed by one curved part 19*a* and two flat-plate parts 19*b*·19*c* connected to each end of the curved part 19*a* is used as the second flat spring constituting the developer powder pressure control member. However, it is not necessary to limit the second flat spring of the present invention to such a structure.

Figure 19:
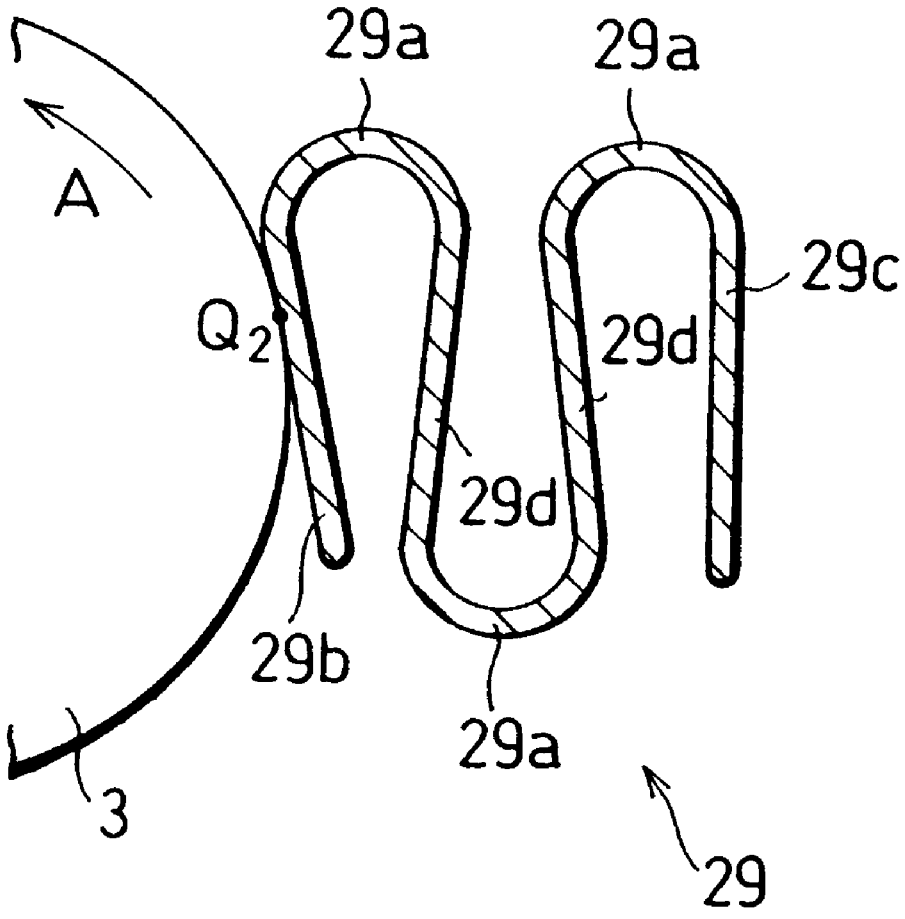
FIG. 19 is a sectional view showing an example in which the toner powder pressure control member includes a flat spring with curved part which is formed by a plurality of curved parts and flat-plate parts.

The second flat spring of the present invention needs to be formed by at least one curved part, and a plurality of flat-plate parts which are connected to each other with the curved part. In particular, as shown in FIG. 19, if the second flat spring of the present invention is formed by a toner powder control member 29 having a plurality of curved parts 29*a*, it is possible to reduce the overall spring contact of the second flat spring. Specifically, the toner powder pressure control member 29 includes a contact flat-plate part 29*b* in contact with the development roller 3, a fixed flat-plate part 29*c* fixed to the developer tank 2, and two unsecured free flat-plate parts 29*d*. The flat-plate parts 29*b*·29*c*·29*d* are connected to the curved parts 29*a* at their ends.

Additionally, in FIG. 7, although the toner powder pressure control member 19 is disposed in contact with the development roller 3, it is possible to place them out of contact with each other by providing a predetermined gap between the toner powder pressure control member 19 and the development roller 3. Considering the stress applied to the toner 1, these members are preferably out of contact with each other. If these members are arranged to come into contact with each other, the amount of charges given to the toner 1 by friction increases. In this case, therefore, the charging of the toner 1 by friction is facilitated.

Furthermore, although not shown in drawings, it is possible to attach a rubber-type elastic body having rubber-like elasticity, such as silicone rubber and urethane rubber, to a surface of the toner powder pressure control member 9, 19 or 29, which comes into contact with the development roller 3, and bring the rubber-type elastic body into contact with the development roller 3.

When forming the curved part 9*a*, 19*a* or 29*a* by bending, the surface of the toner powder pressure control member 9, 19 or 29 usually has a crease, undulation, etc. However, by attaching such a rubber-type elastic body to the development roller 3, the unevenness caused by the crease, undulation, etc. can be accommodated by the rubber-type elastic body and surely eliminated. Moreover, even if there is a slight error in the precision of positioning the toner powder pressure control member 9, 19 or 29, the error is accommodated by the rubber-type elastic body and certainly eliminated like the above. It is therefore possible to certainly facilitate the charging of the toner 1 by friction suppressing the effect of external factors such as a crease and undulation caused in the toner powder pressure control member 9, 19 or 29. Furthermore, it is possible to relax the precision required for the design and positioning of the toner powder pressure control member 9, 19 or 29.

Example 1

Figure 8:
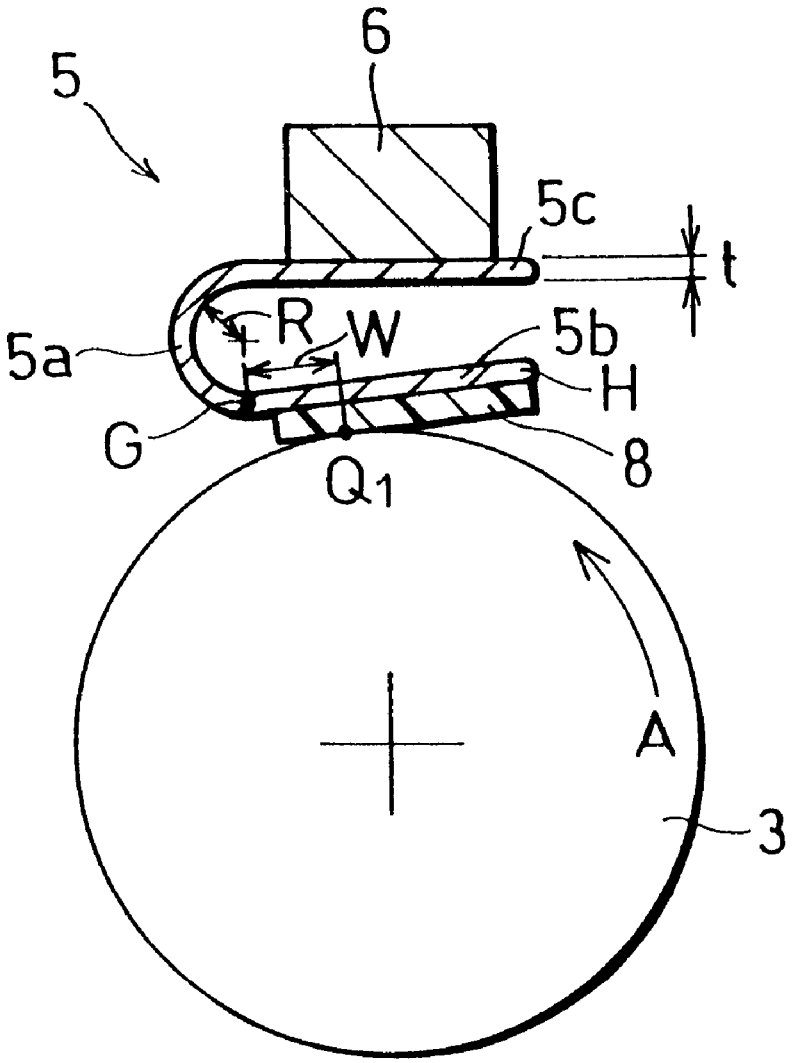
FIG. 8 is a sectional view showing the structure of the essential sections of the developing device.

Referring now to FIG. 8, the following description will explain one example of the present invention. In this example, various designs of the flat springs described in Embodiment 1 or 2 will be explained. For the sake of explanation, the members having the same structure as those used in Embodiments 1 and 2 will be designated with the same reference numbers and their explanation will be omitted.

Load F [kgf] required for displacing a flat spring with N piece of curved part 5*a* (the U-shaped spring 5 or the flat spring 15 with curved part) by Δ mm in a vertical direction, i.e., a direction perpendicular to the contact flat-plate part 5*b* is given by $$F = \frac{Ebt^3}{NR^3 \cdot (\lambda^3 + 9.43\lambda^2 + 24\lambda + 18.85)} \cdot \Delta = K \cdot \Delta \quad (1)$$

where

E is the modulus of elasticity (Young's modulus) [kgf/mm$^2$] of the flat spring with curved part, b is the width [mm] of the contact flat-plate part 5*b* of the flat spring with curved part (the dimension of the flat spring with curved part in the axis direction of the development roller 3), t is the thickness [mm] of the flat spring with curved part, R is the radius [mm] of the curved part 5*a*, Δ is the displacement [mm] of the contact flat-plate part 5*b* in the vertical direction, λ is 2W/R, and W is the length [mm] from the intersection of the contact flat-plate part 5*b* and the normal at the contact point $Q_1$ to the end G of the contact flat-plate part 5*b* on the downstream side. In this case, the coefficient K of the displacement Δ corresponds to the spring constant of the flat spring with curved part.

The maximum stress max applied to the peripheral members of the flat spring with curved part is given by the left equation in Table 1 below.

TABLE 1

| | Present Invention | Conventional Example |
|---|---|---|
| Maximum stress δ max [kgf/mm$^2$] | $\sigma max = \frac{6F(W+R)}{bt^2}$ ] | $\sigma max = \frac{6FW}{bt^2}$ ] |

It is possible to optimize the flat spring with curved part by selecting the radius R of the curved part 5*a*, and the width b, thickness t, length W and displacement Δ of the flat spring with curved part to satisfy the following conditions (i), (ii), and (iii).

(i) Load F required for deforming (displacement Δ) the flat spring with curved part ≧ a force necessary for regulating the thickness of the layer of the toner 1.

(ii) Maximum stress σmax < critical stress of the flat spring with curved part.

(iii) Displacement Δ of the flat spring with curved part >> form error of the flat spring with curved part.

More specifically, preferred parameters of the flat spring with curved part are that t is between 0.1 and 1 [mm], the length W of the straight section is between 5 and 20 [mm], R/t (the radius R of the curved part 5 per mm thickness) is between 10 and 40, and λ is between 2 and 6.

In the conventional elastic body contact methods (elastic trailing contact method and the elastic counter contact method), the maximum stress σmax produced in the peripheral members of the elastic body is given by the right equation in Table 1.

Table 2 shows various flat springs with curved part thus optimized. Here, the number N of the curved part 5*a* is 1, i.e., each of these flat springs with curved part is the U-shaped spring 5, and the material thereof is a phosphor bronze with Young's modulus (modulus of elasticity) of 10,000 kgf/mm$^2$, and a critical stress of 30 kgf/mm$^2$. Moreover, the load F/b necessary for deforming (displacement Δ) the flat spring with curved part per unit length in the width of the contact flat-plate part 5*b* is set to a value not less than 40 gf/cm.

TABLE 2

| | Design 1 | Design 2 | Design 3 |
|---|---|---|---|
| Modulus of Elasticity E [kgf/mm$^2$] | 10000 | 10000 | 10000 |
| Width b of U-shaped spring 5 [mm] | 300 | 300 | 300 |
| Thickness t of U-shaped spring 5 [mm] | 0.11 | 0.2 | 0.13 |
| Length W of straight section [mm] | 5 | 7 | 10 |
| Radius R of curved part 5a [mm] | 2 | 2.6 | 5 |
| Displacement Δ of U-shaped spring 5 [mm] | 1.2 | 0.5 | 7.5 |
| λ = 2W/R | 5.00 | 5.38 | 4.00 |
| Spring constant K [kgf/mm] | 1.00 | 2.36 | 0.16 |
| Load F [kgf] | 1.20 | 1.18 | 1.20 |
| Maximum stress σmax [kgf/mm$^2$] | 13.87 | 5.67 | 21.29 |

In Design 1 shown in Table 2, both of the radius R of the curved part 5*a* and the length W of the straight section of the flat-plate part 5*b* are smaller than those of Designs 2 and 3, and thus a smaller U-shaped spring 5 is realized. In Design 2, the maximum stress σmax is significantly decreased compared to those of Designs 1 and 3, and thus a U-shaped spring 5 with a low stress is realized. Meanwhile, in Design 3, the spring constant K is smaller compared to Designs 1 and 2, and thus a U-shaped spring 5 with a low spring constant is achieved.

Hence, by setting the various parameters to satisfy the conditions (i), (ii) and (iii) mentioned above, it is possible to provide an optimum flat spring with curved part for each developing device.

Example 2

Referring now to FIGS. 8 to 12, the following description will explain another example of the present invention. This example will explain the difference between the properties of the U-shaped spring 5 with low stress obtained by Design 2 of Example 1 and the properties of a toner layer thickness regulating member used in conventional elastic-body-using systems and rigid-body-using systems. For the sake of explanation, the members having the same functions as those of Embodiments 1 and 2 will be designated with the same reference numbers, and their explanation will be omitted.

First, as illustrated in FIG. 8, a U-shaped spring 5 having a thickness t of 0.2 mm and a curved part 5*a* with a radius R of 2.6 mm was prepared on an experimental basis according to Design 2 mentioned above. Here, the length (the distance between G and H) of the contact flat-plate part 5*b* was made 14 mm. Moreover, a rubber-type elastic body 8 made of 2-mm thick silicone rubber was attached to the contact surface of the contact-flat-plate part 5*b* which comes into contact with the development roller 3.

As the toner 1 (see FIG. 1) of this example, for instance, a non-magnetic one-component developer with an average diameter of 7.5 μm formed by adding carbon black, silica, and a charge control agent to, for example, a styrene acrylic resin was used. Furthermore, the development roller 3 was formed by an aluminum development sleeve, and its surface was roughened with spherical beads so that a center line average surface roughness Ra defined by JIS was 1 μm.

In addition, the development roller 3 was arranged to rotate in a counterclockwise direction (in the direction of the arrow A) at a peripheral speed of 190 mm/sec. The toner supply roller 4 (see FIG. 1) was arranged to be in contact with the development roller 3 and rotate in the opposite direction to the development roller 3 (in the clockwise direction).

Although not shown in FIG. 8, a toner powder pressure control member 9 (shown in FIG. 5) for controlling the powder pressure of the toner 1 was disposed at a position which was on the downstream side of the toner supply roller 4 but on the upstream side of the U-shaped spring 5 with respect to the rotating direction of the development roller 3. The toner powder pressure control member 9 was made of a stainless plate with a thickness of 0.2 mm and a protrusion of 20 mm.

Figure 9:
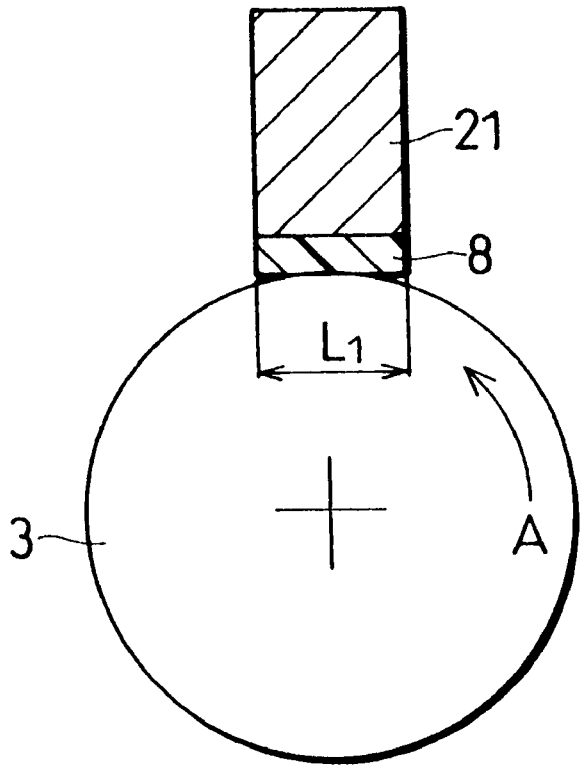
FIG. 9 is a sectional view showing the structure of a rigid bar contact method.
Figure 10:
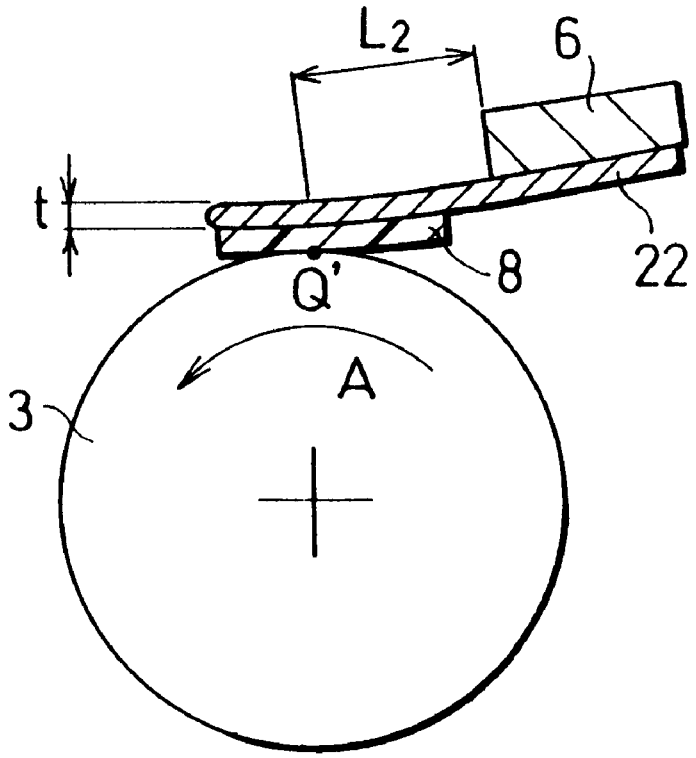
FIG. 10 is a sectional view showing the structure of an elastic trailing contact method.
Figure 11:
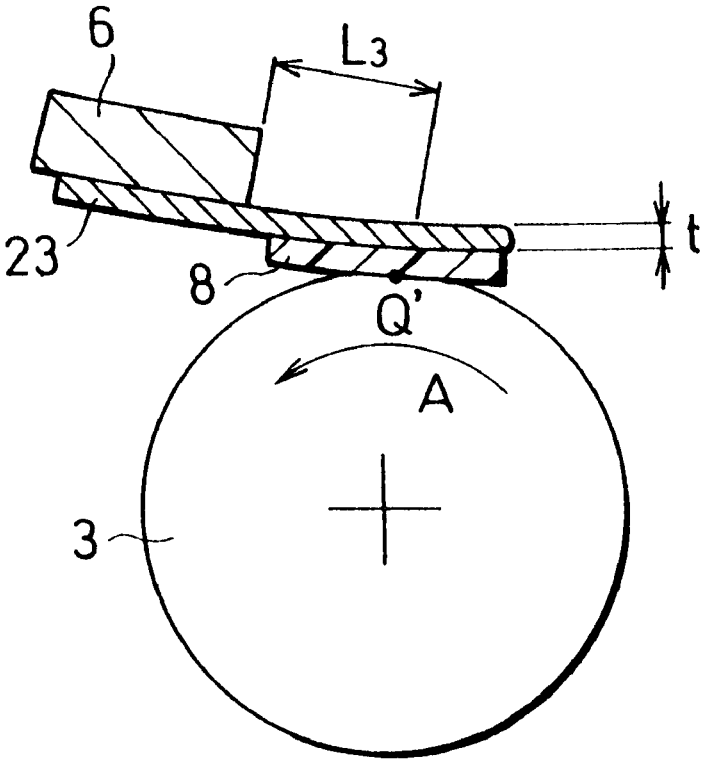
FIG. 11 is a sectional view showing the structure of an elastic counter contact method.

For the purposes of comparison with this example, as shown in FIGS. 9 to 11, toner layer thickness regulating members 21, 22 and 23 used in the conventional rigid bar contact method, elastic trailing contact method and elastic counter contact method were prepared for an experiment. Like this example, the rubber-type elastic body 8 made of 2-mm thick silicone rubber was attached to the contact surface of each of the toner layer thickness regulating members 21, 22 and 23, which comes into contact with the development roller 3.

In the structures shown in FIGS. 9 to 11, although not shown in FIGS. 9 to 11, the toner powder pressure control member 9 shown in FIG. 5 for controlling the powder pressure of the toner 1 was disposed at a position which was on the downstream side of the toner supply roller 4 but on the upstream side of the regulating members with respect to the rotating direction of the development roller 3.

At this time, in the conventional rigid bar contact method, the toner layer thickness regulating member 21 was arranged to satisfy $L_1$=10 mm where $L_1$ is a length along the nip-width direction (the direction of a tangent line of the toner layer thickness regulating member 21 and development roller 3). In the elastic trailing contact method and the elastic counter contact method, the toner layer thickness regulating members 22 and 23 were arranged to satisfy $L_2$=$L_3$=22 mm where each of $L_2$ and $L_3$ represents the distance between the contact point Q' with the development roller 3 and a spring support section (the end of the support member 6 on the contact Q' side) S. Moreover, the toner layer thickness regulating members 22 and 23 were arranged to satisfy the condition $t_2$=$t_3$=0.2 mm where $t_2$ and $t_3$ represent the thicknesses of the toner layer thickness regulating members 22 and 23, respectively.

In the developing devices having the structures shown in FIGS. 8 to 11, the contact load, nip width, toner specific charge (q/m), amount of adhering toner (M/A), and average surface potential ($V_t$) of the toner layer were measured by a predetermined method. The results of the measurements are shown in Table 3.

Here, when the compressive stress to the toner 1 is high, the toner packing factor P increases along with an increase in the stress to the toner 1. Therefore, if the toner layer is formed to have a smaller toner packing factor P, it is possible to decrease the stress to the toner 1.

Hence, in the present invention and conventional examples, the toner packing factor P of the toner layer formed on the development roller 3 was measured as follows and used as a scale for measuring the stresses to the toner 1. Then, evaluation of each structure was made.

The average surface potential $V_t$ of the toner layer is a function of the amount of adhering toner (M/A), toner packing factor P, and toner specific charge (q/m), and expressed by the equation $$V_t = \frac{(M/A)^2}{2\epsilon_0\{1 + P(\epsilon_t - 1)\}\cdot\delta\cdot P}\cdot(q/m) \tag{2}$$

where $\epsilon_o$ is the permittivity of vacuum, $\epsilon_t$ is the relative permittivity of the toner 1, and δ is the true gravity of the toner 1. If equation (2) is rewritten for P, a quadratic equation of P is given as $$(\epsilon_t - 1)P^2 + P - \frac{(M/A)^2}{2\epsilon_0\cdot\delta\cdot V_t}\cdot(q/m) = 0. \tag{3}$$

Then, P is given by $$P = \frac{1}{2(\epsilon_t - 1)}\left\{\sqrt{\frac{1 + 2(\epsilon_t - 1)V_t}{\epsilon_0\delta(q/m)\cdot(M/A)^2}} - 1\right\}. \tag{4}$$

Furthermore, the maximum stress σmax in each of the toner charging and application regulating mechanisms of the structures shown in FIGS. 8 to 11 was obtained by the equation given in Table 1 above. Additionally, the packing density and the thickness of the toner layer in these toner charging and application regulating mechanisms of the structures shown in FIGS. 8 to 11 were calculated by a predetermined method.

The results of the measurement and calculation are shown in Table 3.

TABLE 3

| Toner charging and application regulating mechanism Corresponding drawing | | Rigid Bar Fig. 9 | Elastic trailing Fig. 10 | Elastic counter Fig. 11 | Spring with curved part Fig. 8 | | |
|---|---|---|---|---|---|---|---|
| Measured values | Contact load [gf/cm] | 65 | 65 | 40 | 65 | 40 | 110 |
| | Nip width [mm] | 1.5 | 2.0 | 1.0 | 2.5 | | |
| | Specific charge q/m [μC/g] | 12.8 | 12.9 | 28.0 | 10.5 | 8.2 | 10.5 |
| | Amount of adhering toner M/A [mg/cm$^2$] | 0.54 | 0.46 | 0.40 | 0.59 | 0.60 | 0.60 |
| | Average surface potential Vt [V] | 14.0 | 20.0 | 25.0 | 23.1 | 21.0 | 25.1 |
| Calculated values | Packing factor P of toner | 0.44 | 0.29 | 0.53 | 0.32 | 0.29 | 0.31 |
| | Packing density [g/cm$^3$] | 0.49 | 0.32 | 0.58 | 0.35 | 0.32 | 0.34 |
| | Toner layer thickness [μm] | 11.1 | 14.3 | 6.9 | 16.7 | 18.3 | 17.5 |
| | Maximum stress σmax [kgf/mm$^2$] | | 21.4 | 13.3 | 9.3 | 5.8 | 15.9 |

The following conclusions are derived from the results shown in Table 3.

1̂ Under the same load (linear load), the elastic trailing contact method and the method using the U-shaped spring 5 (hereinafter referred to as the "flat spring with curved part method") exhibit smaller toner packing factor P compared to the other contact methods.

2̂ The toner packing factor P has correlation with the nip width. Namely, under the same load, the toner compressing force per unit area decreases with an increase in the nip width.

The flat spring with curved part method has the widest nip width. It is therefore considered that this method has the lowest toner packing factor P.

3̂ By comparison to the elastic body contact methods (elastic trailing contact method and the elastic counter contact method), the flat spring with curved part method ensures a sufficient amount of adhering toner (M/A), and shows higher efficiency in the application of the toner 1 to the development roller 3.

4̂ The elastic counter contact method has the highest toner packing factor though it has the lowest values in the contact load and nip width. It is thus considered that the elastic counter contact method gives the strongest toner compression force per unit area, and the highest stress to the toner 1.

5̂ Even when the contact load is changed from 40 gf/cm to 110 gf/cm, the flat spring with curved part method shows less change in the toner specific charge (q/m) and the amount of adhering toner (M/A) as compared to the other contact methods. Thus, the flat spring with curved part method is not so susceptible to the variation of load as compared to the other contact methods.

6̂ The flat spring with curved part method shows a small maximum stress σmax compared to the elastic body contact methods (elastic trailing contact method and the elastic counter contact method). Moreover, in the flat spring with curved part method, since the length of a protruding member is made smaller compared to the other contact methods, the flat spring with curved part can never have buckling deformation.

Namely, it is understood that, in the flat spring with curved part method, the toner packing factor P is smaller, and the stress to the toner 1 as well as the stress to the members are reduced as compared to the other contact methods.

Figure 12:
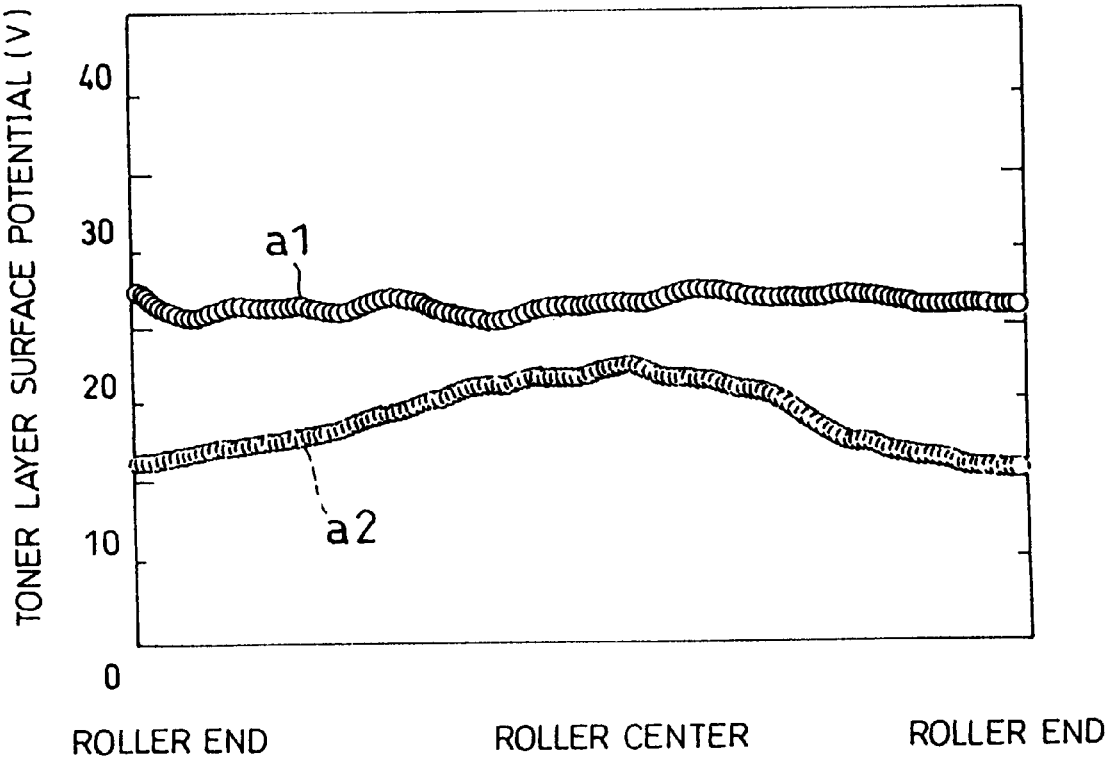
FIG. 12 is a graph showing the distribution of surface potential of a toner layer in the axis direction of the development roller.
Figure 13:
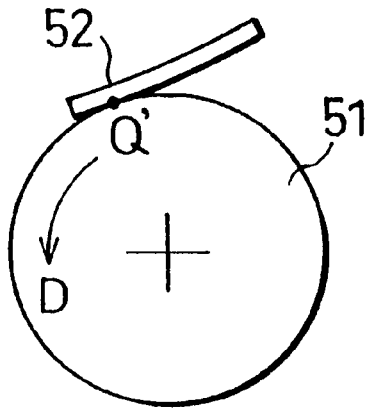
FIG.13 (PRIOR ART)
FIG. 13 is a sectional view showing the structure of a conventional elastic trailing contact method.
Figure 14:
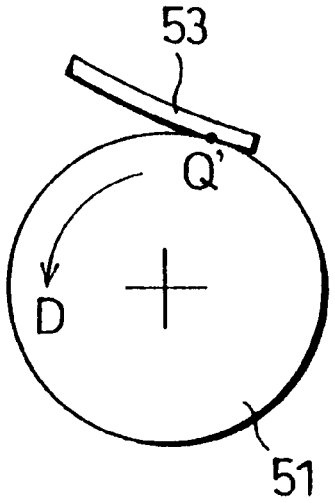
FIG.14 (PRIOR ART)
FIG. 14 is a sectional view showing the structure of a conventional elastic counter contact method.
Figure 15:
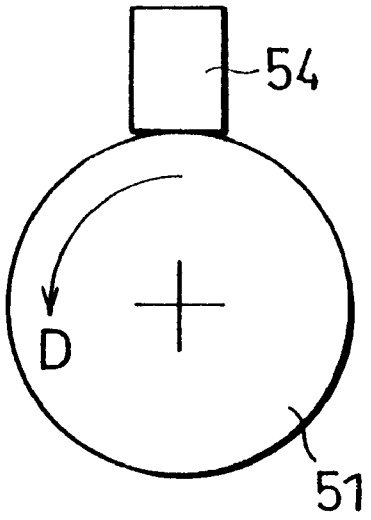
FIG.15 (PRIOR ART)
FIG. 15 is a sectional view showing the structure of a conventional rigid bar contact method.
Figure 16:
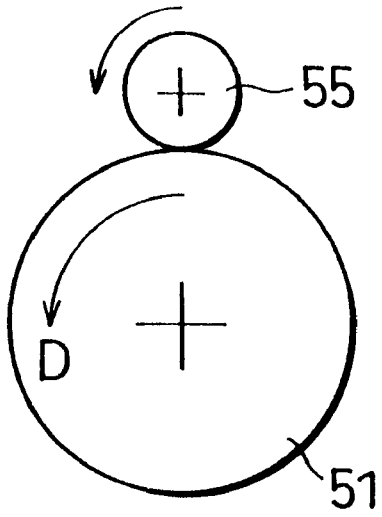
FIG.16 (PRIOR ART)
FIG. 16 is a sectional view showing the structure of a conventional rigid roller contact method.
Figure 17:
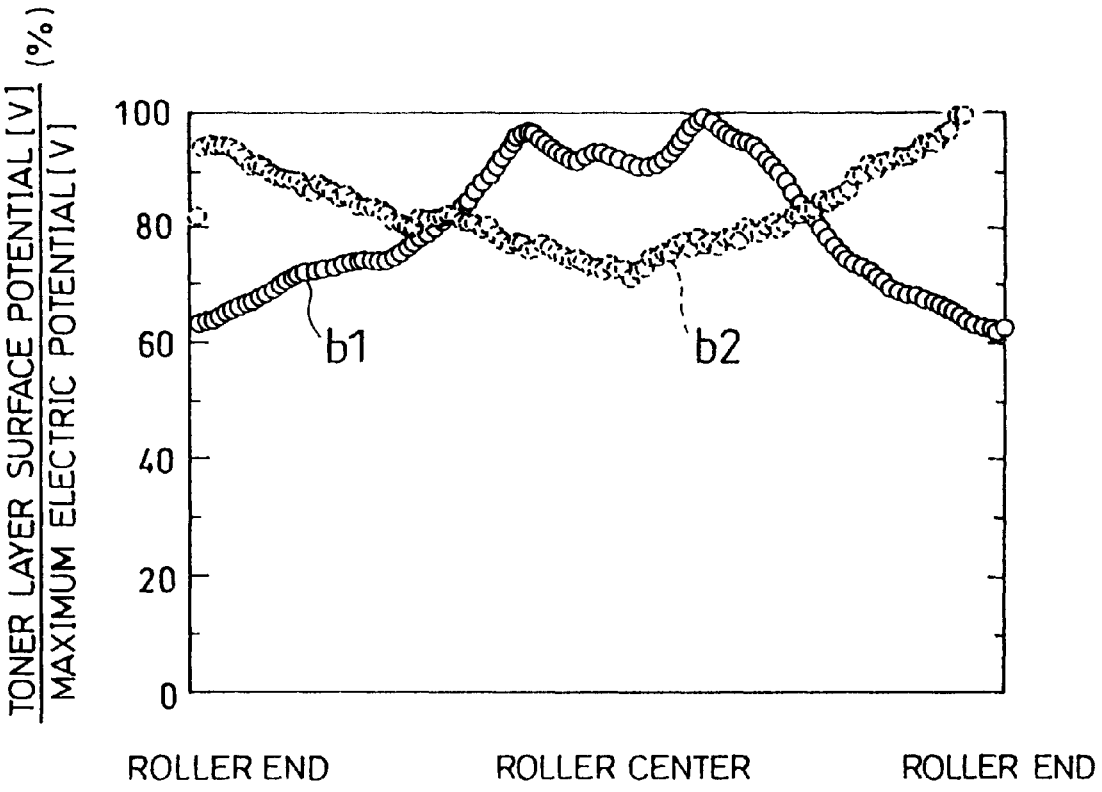
FIG. 17 is a graph showing the ratio of the surface potential of the toner layer in the axis direction of the development roller to a maximum electric potential.

Furthermore, the distribution of the toner layer surface potential in the axis direction of the development roller 3 was examined in the flat spring with curved part method and the rigid bar contact method. The results are shown in FIG. 12. In FIG. 12, the curve a1 corresponds to the flat spring with curved part method, and the curve a2 indicates the rigid bar contact method.

It is understood from FIG. 12 that, in the flat spring with curved part method, a toner layer is formed uniformly along the axis direction of the development roller 3 without causing the toner layer surface potential to change to draw a curve like the rigid bar contact method.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A developing device comprising:

a developer carrier for carrying a one-component developer on a surface thereof;

a developer supply member disposed in cooperative relation with said developer carrier, said developer supply member supplying the developer to said developer carrier; and a developer charging and application regulating member disposed in contact with said developer carrier, said developer charging and application regulating member charging the one-component developer to be supplied to said developer carrier and applying the developer to said developer carrier while regulating a thickness of a layer of the developer, wherein said developer charging and application regulating member includes a first flat spring with a plurality of undistorted first flat-plate parts including a first contact flat-plate part engaging said developer carrier, and a first curved part with which said first flat-plate parts are connected.

2. The developing device as set forth in claim 1, wherein said developer carrier is rotatable.

3. The developing device as set forth in claim 2, wherein said developer charging and application regulating member is arranged so that said first curved part connected to said first contact flat-plate part is located at a position downstream of a contact point of said developer charging and application regulating member and said developer carrier with respect to a rotating direction of said developer carrier, wherein two open spaces are formed between said contact flat-plate part and said developer carrier, the open space formed on an upstream side with respect to the rotating direction of said developer carrier being larger than the open space formed on a downstream side.

4. The developing device as set forth in claim 2, wherein an end of said first contact flat-plate part located on a downstream side with respect to the rotating direction of said developer carrier is connected to said first curved part, and wherein a distance between an end of said first contact flat-plate part located on an upstream side with respect to the rotating direction of said developer carrier and the surface of said developer carrier is greater than a distance between the end on the downstream side and said developer carrier.

5. The developing device as set forth in claim 1, wherein said developer charging and application regulating member includes a plurality of said first curved parts.

6. The developing device as set forth in claim 1, wherein a flat-plate-shaped elastic body having rubber-like elasticity is attached to a surface of said first contact flat-plate part, said flat-plate-shaped elastic body engaging said developer carrier.

7. The developing device as set forth in claim 1, wherein the developer is a non-magnetic one-component developer.

8. The developing device as set forth in claim 1, wherein said first flat spring is made of a metallic elastic material.

9. The developing device as set forth in claim 1, further comprising a support body rotatably supporting said developer carrier, wherein said plurality of first flat-plate parts further includes a fixed flat-plate part fixed to said support body, wherein said fixed flat-plate part is separated from said first contact flat-plate part.

10. The developing device as set forth in claim 9, wherein said fixed flat-plate part is disposed so that the distance from said first contact flat-plate part increases toward a downstream side with respect to the rotating direction of said developer carrier.

11. The developing device as set forth in claim 1, wherein a central angle of said first curved part is not smaller than 180 degrees.

12. The developing device as set forth in claim 2, wherein said developer supply member is a toner supply roller mounted for rotation in a direction opposite to the rotating direction of said developer carrier.

13. The developing device as set forth in claim 2, further comprising a developer power pressure control member disposed in cooperative relation with said developer carrier, said developer powder pressure control member controlling a powder pressure of said developer to be supplied to said developer carrier from said developer supply member, said developer powder pressure control member being disposed at a position downstream of said developer supply member and upstream of said developer charging and application regulating member with respect to the rotating direction of said developer carrier.

14. The developing device as set forth in claim 13, wherein a part of said developer powder pressure control member is in contact with said developer carrier.

15. The developing device as set forth in claim 13, wherein said developer powder pressure control member comprises a second flat spring including a plurality of second flat-plate parts and a second curved part with which said second flat-plate parts are connected.

16. The developing device as set forth in claim 15, wherein said developer powder pressure control member is arranged so that said second curved part is located at a position downstream of a contact point of said developer charging and application regulating member and said developer carrier with respect to a rotating direction of said developer carrier, wherein two open spaces are formed between said developer powder pressure control member and said developer carrier, the open space formed on an upstream side with respect to the rotating direction of said developer carrier being larger than the open space formed on a downstream side.

17. The developing device as set forth in claim 15, wherein said second flat-plate part includes a second contact flat-plate part engaging said developer carrier.

18. The developing device as set forth in claim 17, wherein an end of said second contact flat-plate part located on a downstream side with respect to the rotating direction of said developer carrier is connected to said second curved part, and wherein a distance between an end of said second contact flat-plate part located on an upstream side with respect to the rotating direction of said developer carrier and the surface of said developer carrier is greater than a distance between the end on the downstream side and said developer carrier.

19. The developing device as set forth in claim 15, wherein said developer powder pressure control member includes a plurality of said second curved parts.

20. An electrophotographic apparatus comprising:

a developing device defined in claim 1; and an electrostatic latent image holding body, disposed to face said developing device, for holding an electrostatic latent image.

21. An electrophotographic apparatus comprising:

a developing device defined in claim 2; and an electrostatic latent image holding body, disposed to face said developing device, for holding an electrostatic latent image, wherein said developer charging and application regulating member is disposed at a position downstream of said developer supply member and upstream of said electrostatic latent image holding body with respect to the rotating direction of said developer carrier.

22. The electrophotographic apparatus as set forth in claim 21, wherein said electrostatic latent image holding body is a photoreceptor drum to be mounted to be for rotation in a direction opposite to the rotating direction of said developer carrier.

23. The developing device as set forth in claim 1, wherein said first contact flat-plate part engaging said developer carrier comprises one end that is an unattached free end.

24. The developing device as set forth in claim 1, wherein the developer charging and application regulating member is provided with preselected dimensional parameters in accordance with a desired affect on said developer carrier and said developer.

25. The developing device as set forth in claim 24, wherein said preselected dimensional parameters comprise dimensions of a radius of said first curved part and a width, a thickness, a length and a displacement amount of said developer charging and application regulating member.

26. The developing device as set forth in claim 25, wherein said preselected dimensional parameters are optimized to satisfy the following conditions (i), (ii), and (iii):

(i) a load F required for effecting said displacement amount of said developer charging an application regulating member≧a force necessary for regulating the thickness of a layer of the developer;

(ii) a maximum stress $\sigma max$<a critical stress of the developer charging an application member; and (iii) said displacement amount of said developer charging and application regulating member>a form error of said developer charging and application regulating member.

27. The developing device as set forth in claim 1, wherein t is a thickness of said first flat spring, W is a length of said first contact flat-plate part, R is a radius of said first curved part, and $\lambda$ is 2W/R, and wherein t is between 0.1 and 1 mm, W is between 5 and 20 mm, R/t is between 10 and 40, and $\lambda$ is between 2 and 6.

28. A developing device comprising:

a developer carrier for carrying a one-component developer on a surface thereof;

a developer supply member disposed in cooperative relation with said developer carrier, said developer supply member supplying the developer to said developer carrier; and a developer charging and application regulating member disposed in contact with said developer carrier, said developer charging and application regulating member charging the one-component developer to be supplied to said developer carrier and applying the developer to said developer carrier while regulating a thickness of a layer of the developer, wherein said developer charging and application regulating member includes a first flat spring with a plurality of first flat-plate parts including a first contact flat-plate part engaging said developer carrier, and a first curved part with which said first flat-plate parts are connected, wherein each of ends of said first curved part forms a substantially single plane with said first flat-plate parts connected to said first curved part.

* * * * *